US008418308B2

(12) United States Patent
Major

(10) Patent No.: US 8,418,308 B2
(45) Date of Patent: Apr. 16, 2013

(54) GRID PAINT DIPPER

(76) Inventor: Willis Gerald Major, Buffalo, NY (US)

( * ) Notice: Subject to any disclaimer, the term of this patent is extended or adjusted under 35 U.S.C. 154(b) by 507 days.

(21) Appl. No.: 12/715,419

(22) Filed: Mar. 2, 2010

(65) Prior Publication Data

US 2011/0214243 A1 Sep. 8, 2011

(51) Int. Cl.
*B44D 3/12* (2006.01)

(52) U.S. Cl.
USPC ..... 15/257.06; 15/257.05; 220/736; 220/701; 220/697

(58) Field of Classification Search ..... 15/236.03, 15/142, 257.01, 257.05, 257.06, 264, DIG. 9; 134/900; 294/7, 179; 220/771, 695–702, 220/736; 210/470; D32/54, 53.1; *B05C 21/00*
See application file for complete search history.

(56) References Cited

U.S. PATENT DOCUMENTS

| | | | | | |
|---|---|---|---|---|---|
| 452,044 | A | * | 5/1891 | Dolittle | 210/470 |
| 2,259,927 | A | * | 10/1941 | Dunton | 220/736 |
| 2,369,335 | A | * | 2/1945 | Burman | 15/257.05 |
| 2,661,858 | A | * | 12/1953 | Howell | 15/257.06 |
| 2,827,648 | A | * | 3/1958 | Geisz | 15/257.05 |
| 2,893,230 | A | | 7/1959 | Gibson | |
| 2,911,663 | A | * | 11/1959 | Geary | 15/257.06 |
| 2,972,765 | A | * | 2/1961 | Macy et al. | 15/257.06 |
| 3,394,425 | A | | 7/1968 | Welt | |
| 3,409,931 | A | * | 11/1968 | Graf | 15/257.06 |
| 3,837,034 | A | | 9/1974 | Leffert et al. | |
| 3,940,824 | A | | 3/1976 | Gioia et al. | |
| 4,145,789 | A | | 3/1979 | Morgan, Sr. | |
| 4,865,282 | A | | 9/1989 | Yonkman et al. | |
| 5,054,661 | A | | 10/1991 | Hollje | |
| 5,201,439 | A | * | 4/1993 | Davies | 220/735 |
| 5,283,928 | A | | 2/1994 | Linn et al. | |
| 2,699,965 | A | | 1/1995 | Owen | |
| 5,493,751 | A | * | 2/1996 | Misiukowiec et al. | 15/257.06 |
| 5,511,279 | A | * | 4/1996 | Ippolito | 15/257.06 |
| 5,553,348 | A | * | 9/1996 | Brandenburger | 15/257.06 |
| 5,727,708 | A | * | 3/1998 | Erickson | 220/23.87 |
| 6,419,106 | B1 | * | 7/2002 | Bebak | 220/570 |
| 6,493,901 | B1 | * | 12/2002 | Jones | 15/257.06 |
| 6,622,340 | B2 | * | 9/2003 | Rosa | 15/257.06 |
| 6,802,431 | B2 | | 10/2004 | Schinkel | |
| 7,137,168 | B2 | * | 11/2006 | Mann | 15/257.06 |
| 7,992,250 | B2 | * | 8/2011 | Prokop | 15/257.06 |
| 8,016,075 | B2 | * | 9/2011 | Pohl | 182/129 |
| 2002/0005409 | A1 | * | 1/2002 | Rosa | 220/570 |
| 2003/0000041 | A1 | * | 1/2003 | Jones | 15/257.06 |
| 2003/0192824 | A1 | * | 10/2003 | Marriott et al. | 210/470 |
| 2004/0148729 | A1 | * | 8/2004 | Fawcett | 15/257.05 |
| 2009/0019659 | A1 | * | 1/2009 | Hill et al. | 15/257.06 |
| 2012/0137463 | A1 | * | 6/2012 | Velazquez Arvizu | 15/257.05 |

* cited by examiner

*Primary Examiner* — Robyn Doan
*Assistant Examiner* — Tatiana Nobrega

(57) ABSTRACT

A grid paint scooping device which is an article of manufacture comprising; a vertical elongated substantially flat grid which is partially immersed into a paint container with a handle at the top of said flat grid and attached at the bottom of the flat grid is an outwardly extending horizontal scooping reservoir which is substantially parallel to the bottom of said paint container during paint scooping events, wherein said grid paint scooping device uses said scooping reservoir for lifting a sufficient amount of paint out of the paint container for the purpose of saturating a roller cover with said paint in the reservoir and removing the excessive paint from the roller cover by use of said flat grid to allow the right amount of the paint to be evenly distributed on the surface of the roller cover before painting objects with the roller cover.

7 Claims, 28 Drawing Sheets

GRID PAINT DIPPER

CROSS-REFERENCE TO RELATED APPLICATIONS

Not applicable

BACKGROUND

1. Field of Invention

Figure 1:
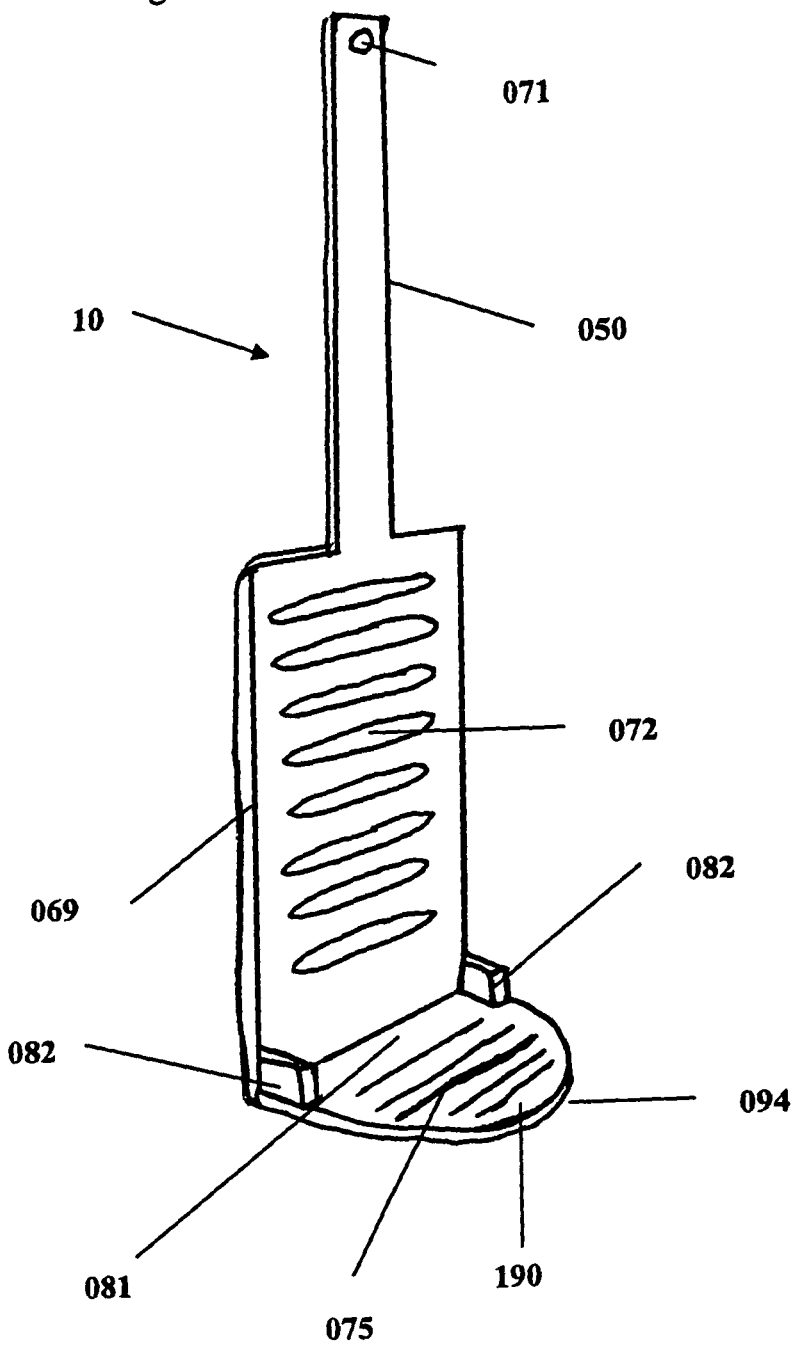

This invention relates to paint roller wiping devices and grids that have features used to wipe off excessive paint, stain, and other liquids. These flat boards are typically inserted into a can or pail of paint, stain or other liquids. When in use, a roller cover is dipped into the can of paint and then rolled on the surface of the grid board to remove excess paint from the cover.

2. Description of Prior Art

When painting, staining, cleaning, or applying chemicals to the surface area of objects, trays are use to hold the various liquids. In the case of using a paint roller to paint a wall, paint is poured into a tray and the paint roller is dipped into the "paint holding end" of the tray and the paint roller cover is rolled over a raised section of the tray in order to remove the excessive paint from the paint roller cover while spreading paint evenly onto the roller cover. Once the excessive paint is removed, the paint roller is use to paint the wall and the above process is repeated until the entire wall is painted. There are many variations of trays and buckets on the market, but they are made for paint to be poured into the tray or bucket which means a painter must continually waste time pouring paint into the tray or bucket in order to use the tray or bucket. To eliminate the need of pouring paint into a tray, a paint removal device called a grid or screen is used which is inserted directly into various sized paint cans, buckets or 5 gallon paint pails. The grid or screen can have multiple holes throughout its entire flat surface or raised features throughout its surface that would be used for removing the excessive paint that is on a roller cover or brush. The user would stick the grid or screen directly into the paint can or pail, dip the roller cover into the paint and then roll the cover across the surface of the grid to remove the excessive paint from the cover. There are plastic grids and metal grids and even some with a feature to hang the grid over the edge of the paint can or 5 gal pail. The grid has eliminated a need for a paint tray because the grid is directly inserted into the paint can or pail so there would be no need to pour paint into a tray. Nonetheless, there is still a need for a new type of paint grid distribution and excess paint removal device that can also be put directly into a paint can or pail and that not only has features to remove excessive paint from a paint roller cover, but unlike the other devices has added flexibility to be used with paint rollers that have multi roller covers and that also have the means to easily put paint onto the paint roller covers without dipping the paint roller into the paint can or bucket. Most trays can not be used with paint rollers that have two rollers attached a certain angles. It is impossible to use the standard trays when the roller covers are at acute angles from each other. I encountered this problem after inventing a paint roller with dual roller covers that were at an acute angle. I learned that the typical paint trays could not be used and if using a grid I would have to fully immerse both roller covers into the paint in order to put an adequate amount of paint on the covers, which seemed to be more time and trouble when it came to removing the excessive paint from the covers. Dipping both angled roller covers into the paint would cause paint to over soak the rollers and would also cause unwanted paint to get onto the roller shaft and handle attachments leaving the roller to drip paint during operation. So I needed a special grid that was a combination of a grid and paint dipper to allow me to not only lift an adequate amount of paint out of the can of paint to be applied to each roller but to also be able to remove the excessive paint from dual roller covers that were at angles from each other. Thus I came up with a novel idea of combining a grid with a paint scooping device. Furthermore this new invention would allow the grid to be used inside of various size paint cans, buckets and paint pails that are bought in stores. By making the new invention in many sizes to fit the many different sizes of paint cans/pails and rollers the new invention would be vary adaptable.

Prior art grid devices have attempted to provide a solution to one or more problems envisioned hereby include Linn et al (U.S. Pat. No. 5,283,928) which discloses a universal paint grid for attachment to either the internal ledge of container or external ledge of a different container comprising a paint grid member having a porous plate for rolling a paint roller thereon to remove excess paint from the paint roller. Like most paint grids, this grid provides a means to remove excess paint from a paint roller but it still lacks a means to lift paint from a can and soak the paint roller cover with the paint. With using this invention one must still dip the roller into the paint can in order to soak the roller cover with paint and then use the grid to remove the excess paint from the roller cover. Whereas my invention not only provides a means to soak the paint roller covers with paint by way of a paint dipper but also provides a means to remove excess paint from the paint roller covers using its attached grid plate.

Coughlan (U.S. Pat. No. 2,699,965) discloses a flexible mesh with stitched pockets in the form of a sheet or opened ended cylinder with a handle. The mesh is dipped into the paint can and the pocket hole in the sheet holds the paint so as a paint roller cover is roller across the sheet the cover picks up paint. In the case of the cylinder formed mesh with both ends opened, the cylinder mesh is dipped in the paint and after being raised with the handle the roller cover is inserted inside of the cylinder mesh and rolled around the inner diameter of the mesh to put paint on the roller cover. This device is disposed within the paint can during the painting operation and is lifted out of the paint can when the operator wishes to load the paint roller with paint. The draw back of this device is although the sheet may pick up a small amount of paint in the small pockets but because the mesh still has holes it is still like other grid devices in that they are not a sufficient way to soak an adequate amount of paint onto the roller cover before removing the excessive paint. My invention uses a paint dipping means to adequately soak the roller cover with as much paint as need in the least amount of time without over soaking the paint roller, whereas this device in U.S. Pat. No. 2,699,965 attempt to provide this soaking of paint and removal of excess paint within the same mesh fabric but since mesh is porous it still will not supply an adequate amount of paint to soak the covers with paint. My invention uses a two step process by first soaking the roller cover with my paint dipping and mini container end and then removing the excess paint with a flat sheet end that contains the paint removing features. This two step process makes my invention more effective to use, allows for a greater amount of paint soaking and controlling of the soak and is quicker to use.

U.S. Pat. No. 4,865,282 discloses a combination paint roller wiper and paint brush holder for use in a paint bucket. This device can also be installed in the paint bucket and provides a means to remove excess paint from paint rollers. The pocket is secure to the upper portion of the mesh wiper but is only designed for the reception of a paint brush. My invention positions a paint dipper at the bottom of the paint roller wiper for the purpose of lifting the paint from the paint bucket and using this paint dipper to soak the roller with paint. With U.S. Pat. No. 4,865,282 the paint roller would still be dipped into the paint and although this patent has a pocket it is not intended for the same purpose as the paint dipper in my invention, which is shown by the fact the pocket is not position at the bottom of the wiper to allow for paint to be scooped out of the bottom of the paint bucket, furthermore the pocket has perforations in it which would not allow for the paint to be contained in the pocket, and finally the inventor states that the pocket is for storing paint brushes. Therefore my invention solves problems that this inventor has no intention of solving and did not foresee.

U.S. Pat. No. 4,145,789 discloses a paint distributing plate for insertion into an open mouthed receptacle. Like other grid devices this device allows for paint to be distributed onto paint rollers but this device also lacks a paint dipper or mini container to adequately soak the paint roller covers with paint before removing excess paint or evenly distributing paint to the roller covers. To adequately saturate the paint roller covers an operator would still have to dip the rollers covers into the paint bucket before using this plate. My invention allows for the paint roller to be adequately covered with paint without the paint roller being dipped into the paint bucket by way of using my paint dipper to lift paint out of the bucket and to apply the paint to the roller cover.

U.S. Pat. No. 2,893,230) discloses a one piece paint roller wiping and saturating device for insertion into a paint bucket. Like other grid devices this device provides a means for removing excess paint from paint rollers but it still lacks a paint dipper or mini container at the bottom of the wiper to allow for adequate paint saturation of the paint roller covers. An operator would still have to dip the roller covers into the paint to allow for adequate saturation. My invention provides for more control of the amount of saturation by having a paint dipper at the end of the wiper grid.

U.S. Pat. No. 3,394,425 discloses a paint distributor for use with a paint roller comprising a sheet having portions defining a rough frictional perforate surface, and side bars rotatably connected along opposing edges of side sheet. Like other grid devices this device provides a means for removing excess paint from paint rollers but it still lacks a paint dipper at the bottom of the wiper to allow for adequate paint saturation of the paint roller covers. An operator would still have to dip the roller covers into the paint to allow for adequate saturation. My invention provides for more control of the amount of saturation by having a paint dipping means at the end of the wiper grid.

U.S. Pat. No. 7,137,168 B2 discloses a paint roller grid comprising a wiping surface for wiping a roller cover there against. Like other grid devices this device provides a means for removing excess paint from paint rollers but it still lacks a paint dipping means at the bottom of the wiper to allow for adequate paint saturation of the paint roller covers. An operator would still have to dip the roller covers into the paint to allow for adequate saturation. My invention provides for more control of the amount of saturation by having a paint lifting means at the end of the wiper grid.

U.S. Pat. No. 6,802,431 B2 discloses a paint tray that an open reservoir, handle, spout and supporting leg. Paint from a paint can is poured into this tray under normal use. This is a disadvantage because a painter must waste time pouring paint into the tray because this tray was not intended to be inserted into a paint can or bucket but rather to be used as a stand alone device. The inclined ribbed surface is integral with the open reservoir in this device whereas in my invention the surface is separate from the reservoir in that the reservoir is at the end of the surface that allow for removal of excess paint from paint rollers. This device has raised walls all around the device and is a disadvantage when trying to use multi rollers. My invention allows for multi rollers to easily be saturated with paint and have excess paint removed by way of a wall-less grid sheet of my invention due to the wall less sheet being thin enough to fit between multi rollers which is one of the important parts of my invention in allowing both single and multi rollers to be used.

US 2002/0005409 A1 discloses a paint tray that can be used in the vertical as well as the horizontal position to hold paint for use with a roller. This paint tray is intended for stand alone use where a minimum of 3 gals of paint can be poured into the tray. This tray has surrounding walls which are used to hold the paint inside of the tray. Paint from a paint can is poured into this tray under normal use. This is a disadvantage because a painter must waste time pouring paint into the tray because this tray was not intended to be inserted into a paint can or bucket but rather to be used as a stand alone device. The raised zigzag shaped units that form an incline in the tray are surrounded by walls whereas in my invention the excess paint removing grid surface is separate from the reservoir in that the reservoir is at the end of the grid surface. This device has raised walls all around the device and is a disadvantage when trying to use multi rollers. My invention allows for multi rollers to easily be saturated with paint and have excess paint removed by way of a wall-less grid sheet of my invention due to the wall-less sheet being thin enough to fit between multi rollers which is an important part of my invention in allowing multi rollers to be used.

U.S. Pat. No. 6,419,106 B1 discloses a vertical paint tray with a square reservoir that is surrounded by walls and a ramp extending above the reservoir at an angle from the reservoir with a back wall extending upward above the height of the ramp. The ramp having a lip and series of rounded edges for removing excess paint from a painting tool. The back wall extending higher than the ramp would prevent multi rollers from being used with this tray. The ramp would need to be very thin to fit between two rollers. In my invention the grid surface is thin enough to fit between two rollers and also has a reservoir that is small enough where the entire paint roller would not have to be fully immersed in the reservoir. This tray has surrounding walls which are used to hold the paint inside of the tray. Paint from a paint can is poured into this tray under normal use. This is a disadvantage because a painter must waste time pouring paint into the tray because this tray was not intended to be inserted into a paint can or bucket but rather to be used as a stand alone device. My invention allows for multi rollers to easily be saturated with an adequate amount of paint and have excess paint removed by way of a wall-less grid sheet of my invention due to the wall-less sheet being thin enough to fit between multi rollers which is an important part of my invention in allowing multi rollers to be used.

U.S. Pat. No. 5,054,661 discloses a paint bucket with a cylindrical container with a upward support projection including a handle and an outward projection pouring spout with tips for removing excess paint. This is a disadvantage because a painter must waste time pouring paint into the tray because this tray was not intended to be inserted into a paint can or bucket but rather to be used as a stand alone device and thus serves a different purpose than my invention. In addition this paint bucket outward projection does not easily lend itself to remove excess paint from dual paint rollers and one would have to dip the roller into the bucket in order to saturate the paint roller cover with paint. My invention allows for multi rollers to easily be saturated with an adequate amount of paint and have excess paint removed by way of a wall-less grid sheet of my invention due to the wall-less sheet being thin enough to fit between multi rollers which is an important part of my invention in allowing multi rollers to be used.

U.S. Pat. No. 2,661,858 discloses a paint receptacle for use with a roller type applicator comprising a body for containing paint or the like having side walls and a bottom over which the rollers are roller in applying the paint thereto. This is a disadvantage because a painter must waste time pouring paint into the tray because this tray was not intended to be inserted into a paint can or bucket but rather to be used as a stand alone device and thus serves a different purpose than my invention. But rather this device was intended to be used as a device that the painter could hang on his shoulder to facilitate the conveyance for the painter during painting. In addition, this paint receptacle does not easily lend itself to remove excess paint from dual paint rollers due to the receptacle having walls. My invention allows for multi rollers to easily be saturated with an adequate amount of paint and have excess paint removed by way of a wall-less grid sheet of my invention due to the wall-less sheet being thin enough to fit between multi rollers which is an important part of my invention in allowing multi rollers to be used.

U.S. Pat. No. 3,837,034 discloses a painter's implement comprising an open-top substantially rectangular container, a diagonally-upward disposed roller ramp dividing the container into a fluid-tight paint reservoir forward of the ramp and a storage bin under the over hang of the roller ramp, the sides of the roller ramp having flanges which join the sides of the roller stop. This is a disadvantage because a painter must waste time pouring paint into the tray because this tray was not intended to be inserted into a paint can or bucket but rather to be used as a stand alone device and thus serves a different purpose than my invention. In addition, this paint container does not easily lend itself to remove excess paint from dual paint rollers due to the roller ramp having flanges which join the sides of the roller stop. My invention allows for multi rollers to easily be saturated with an adequate amount of paint by way of the small reservoir at the end of the grid and have excess paint removed by way of a wall-less grid sheet of my invention due to the wall-less sheet being thin enough to fit between multi rollers which is an important part of my invention in allowing multi rollers to be used.

U.S. Pat. No. 2,827,648 discloses device for removing paint from paint brushes dipped into a container of paint, comprising an elongated substantially flat rectangular body of sheet of material for mounting in said container, an outwardly extending support flange located at an angle to the plane of said body and arranged substantially parallel to the bottom of said container when positioned therein for resting, said body having substantially straight parallel side edges. This device was intended for use with a paint brush and like other grid devices this device could be used to allow for paint to be distributed onto paint rollers but this device also lacks a paint lifting means to adequately soak the paint roller covers with paint before removing excess paint or evenly distributing paint to the roller covers. To adequately saturate the paint roller covers an operator would still have to dip the rollers covers into the paint bucket before using this plate. My invention allows for multi rollers to easily be saturated with an adequate amount of paint by way of the small paint lifting container at the end of the grid and have excess paint removed by way of a wall-less grid sheet of my invention due to the wall-less sheet being thin enough to fit between multi rollers which is an important part of my invention in allowing multi rollers to be used. My invention allows for the paint roller to be adequately covered with paint by way of using my paint lifting container to avoid having to dip the paint roller into the paint can to apply paint to the paint roller cover. The parallel side edges in this device prevents dual roller from being used with it due to the edges which act as a wall and not being thin enough to fit between dual rollers that are position at small acute angles from only a small space between the roller covers.

U.S. Pat. No. 3,940,824 discloses an improved tray and container apparatus comprising a container section having a generally rectangular cross-section with an open top and generally round bottom; a tray portion integrally formed to one edge of the open top portion of said container section at an obtuse angle to form a unitary unbroken connection between the tray portion and container section; wherein a screen is carried in said tray portion disposed above the tray surface to facilitate smooth distribution of material on a paint roller. This container has a disadvantage in that the paint rollers have to be dipped entirely into the container in order to saturate the roller cover with paint. My invention uses a paint dipping means to lift the paint out of a paint can then to apply the paint to the roller cover instead of immersing the entire roller cover into the paint. This device in U.S. Pat. No. 3,940,824 is not intended to be inserted into a paint can like my invention. This device is a stand alone device and not a grid or screen device to use for paint insertion. This device has raised walls that will prevent dual rollers to be used due to the walls being too high to fit between two rollers that are very close together.

Accordingly, in spite of the various efforts of the prior art, there is still a need for an improved grid like device, for paint rollers, that can also be directly insert into paint cans, buckets and pails, that can also provide even paint distribution onto roller covers, that can also be used for removal of excess paint on roller covers, but has the added benefit in that it can more effectively be used with paint rollers that have multi roller covers, and that has the added benefit that it has a paint scooping means at the end of the grid so when paint is at a low level in the paint can or pail the paint can be lifted from the bottom of the paint can or pail and an adequate amount of paint can then be applied onto the paint roller cover with my new invention without having to dip the paint roller into the paint can or pail to apply paint to the cover. This paint grid dipper combination is the novel idea of my invention.

SUMMARY

In accordance with the present invention, the "grid paint dipper" mainly comprises a paint roller cover grid wiping plate at one end and a paint dipper at the bottom of said plate. The present invention allows the operator to hold the handle of the "grid paint dipper" to insert the "grid paint dipper" into a can or pail of paint bought from a store and scoop up an adequate amount of paint from the can of paint to pour onto the paint roller cover or place the cover into the dipper end of the "grid paint dipper" then roll the paint roller cover onto the wiper plate to distribute the paint evenly onto the roller cover and remove excess paint from the roller cover before applying the paint roller to the object to be painted. The paint dipper is formed in such a way to allow the roller cover to have its knit covering soaked with paint and when the paint level is low in the bucket or can of paint, the dipper can scoop up paint from the bottom of the can and the operator can pour the paint from the dipper onto the paint roller cover or place the paint roller cover into the dipper without having to put the roller cover deep inside of the paint can or bucket to reach the low level of paint at the bottom of the paint can or pail.

Objects and Advantages

Accordingly, several objects and advantages of the "grid paint dipper" described in my above patent are:

(a) to provide an easier way to apply an adequate amount of paint to paint roller covers in addition to a way to remove excess paint from the roller covers while distributing paint evenly across roller covers;

(b) to provide a faster way to apply paint to paint roller covers in addition to a way to remove excess paint from the roller covers while distributing paint evenly across roller covers;

(c) to provide a more efficient way to apply paint to paint roller covers in addition to a way to remove excess paint from the roller covers while distributing paint evenly across roller covers;

(d) to provide a way to scoop paint from the bottom of a paint can or pail when paint is at a very low level to apply paint to paint roller covers in addition to a way to remove excess paint from the roller covers while distributing paint evenly across roller covers;

(e) to provide a simple way to apply paint to paint roller covers in addition to a way to remove excess paint from the roller covers while distributing paint evenly across roller covers;

(f) to provide a way better way to apply paint to dual angled roller covers in addition to a way to remove excess paint from the roller covers while distributing paint evenly across roller covers;

Further objectives and advantages of my invention will become apparent from a consideration of the drawings and ensuing description.

DRAWING FIGURES

In accordance with the present invention, the "grid paint dipper" mainly comprises a paint roller cover grid wiping plate and a paint scooping & applying means attached to the bottom of said plate.

FIG. 1) shows the "grid paint dipper" with the partially extended side walls & extended tongue reservoir with grooves.

Figure 2:
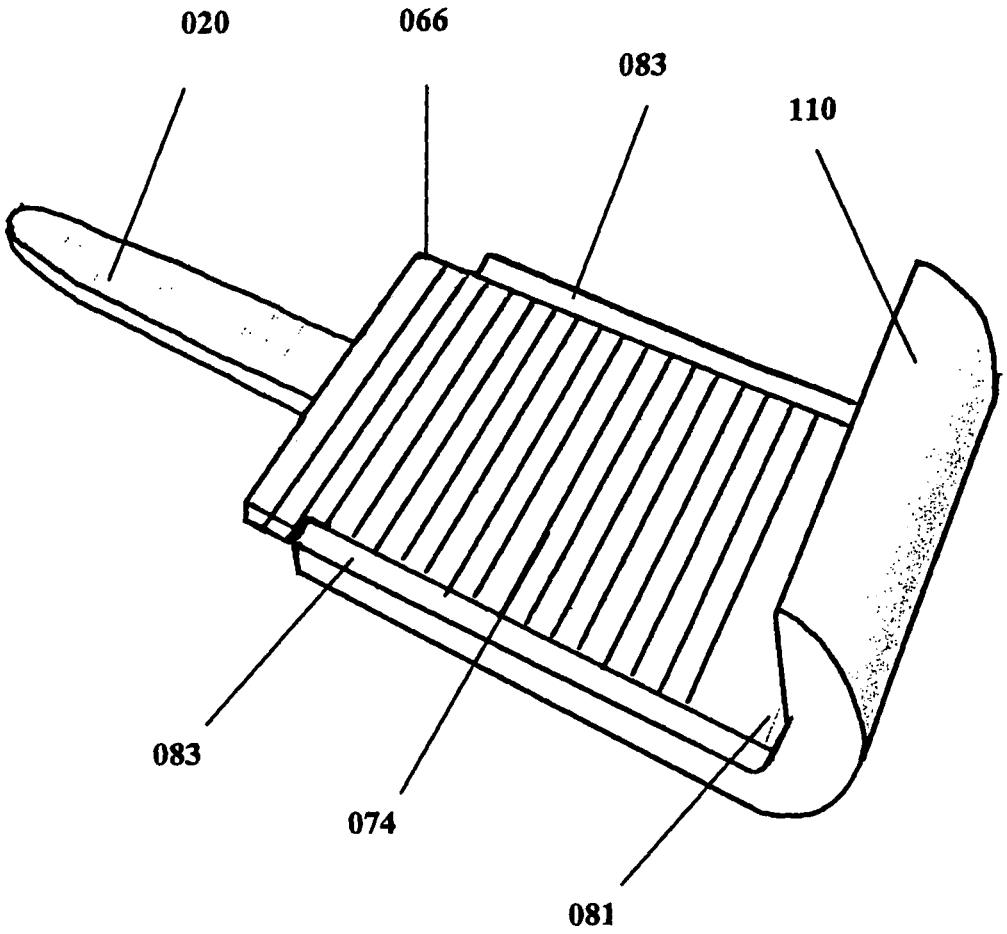

FIG. 2) shows the "grid paint dipper" with the barrel shape reservoir and grooves in the grid plate.

Figure 3:
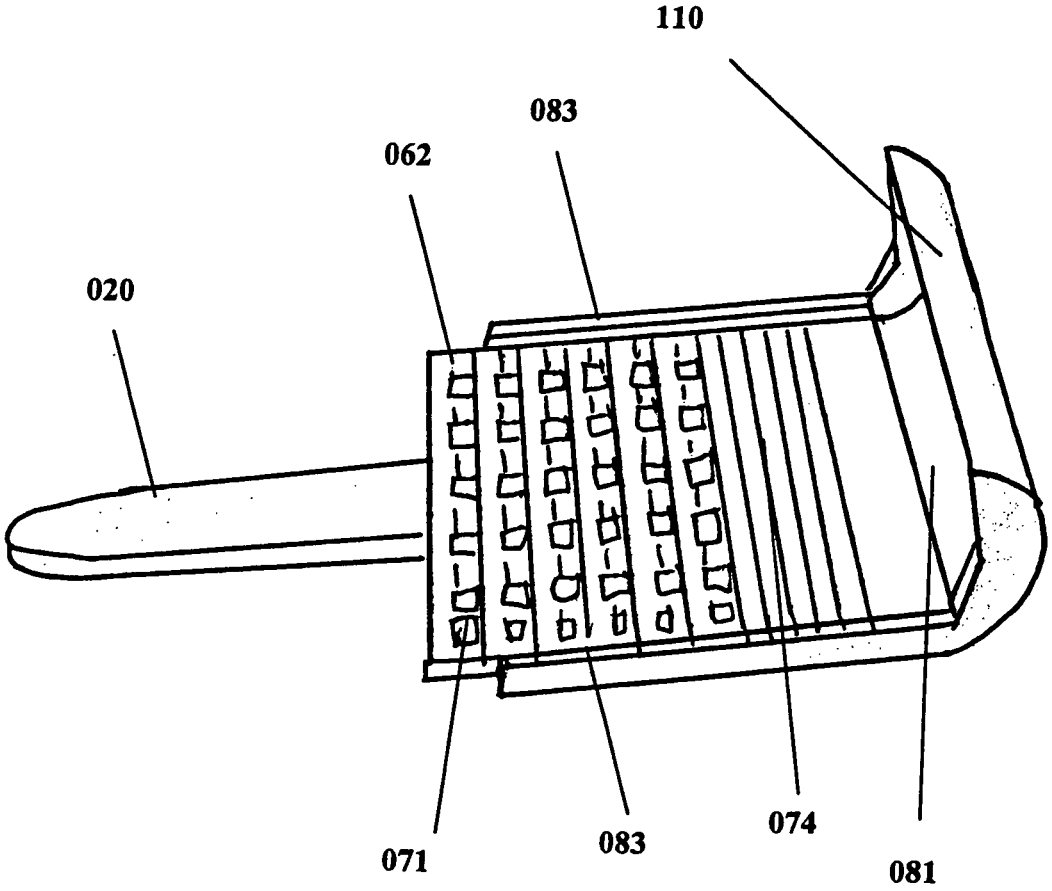

FIG. 3) shows the "grid paint dipper" with the barrel shape reservoir and grid plate with holes.

Figure 4:
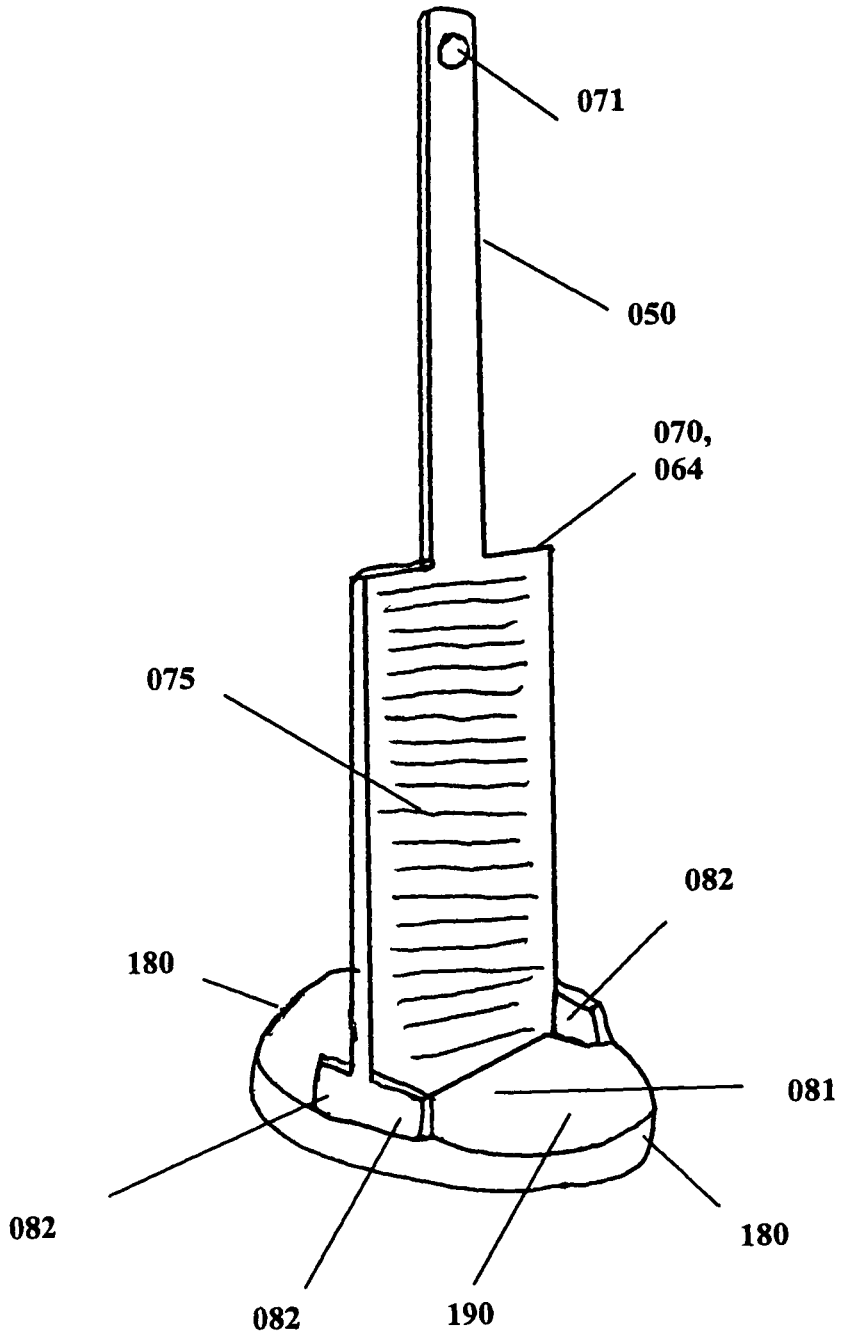

FIG. 4) shows the "grid paint dipper" with dual reservoirs on front & back of grid plate with partial side walls.

Figure 5:
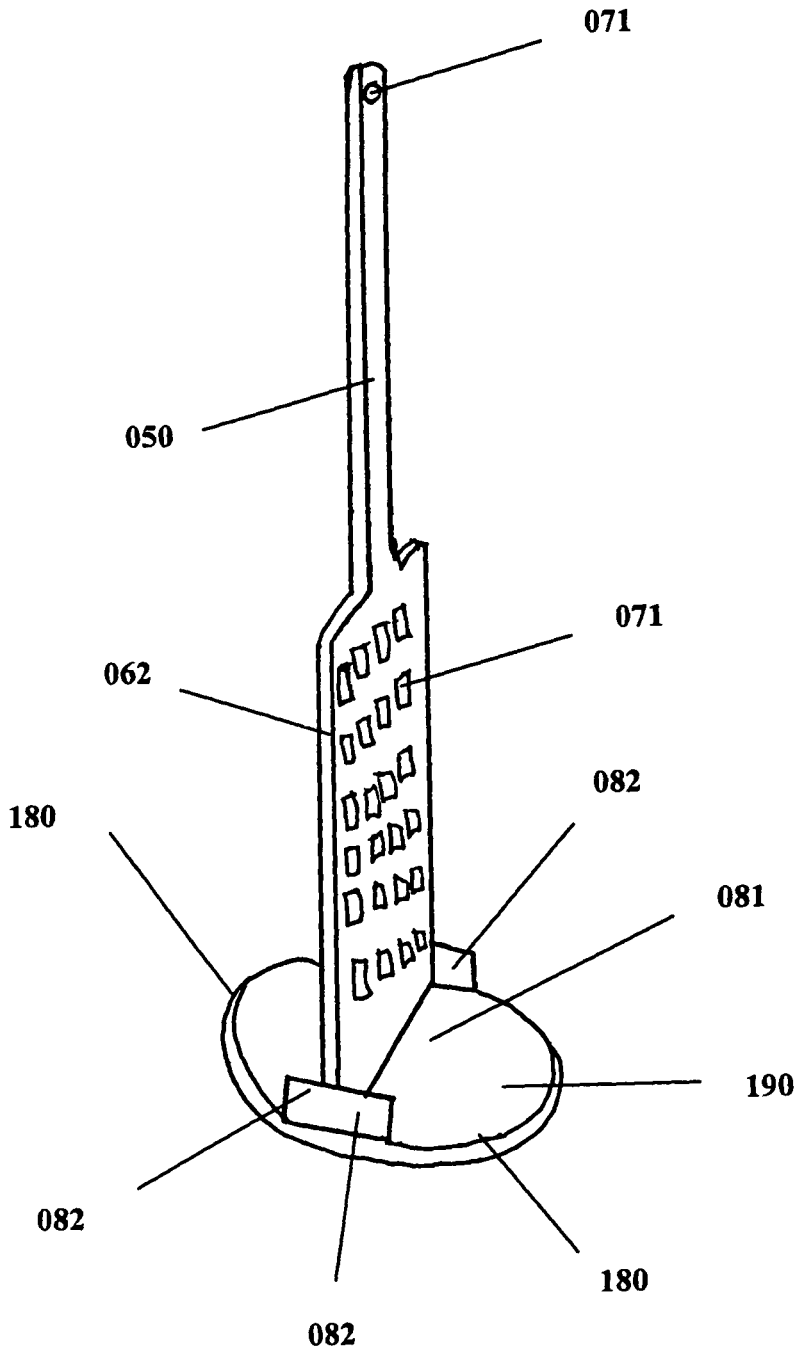

FIG. 5) shows the "grid paint dipper" with dual reservoirs and a grid plate with holes.

Figure 6:
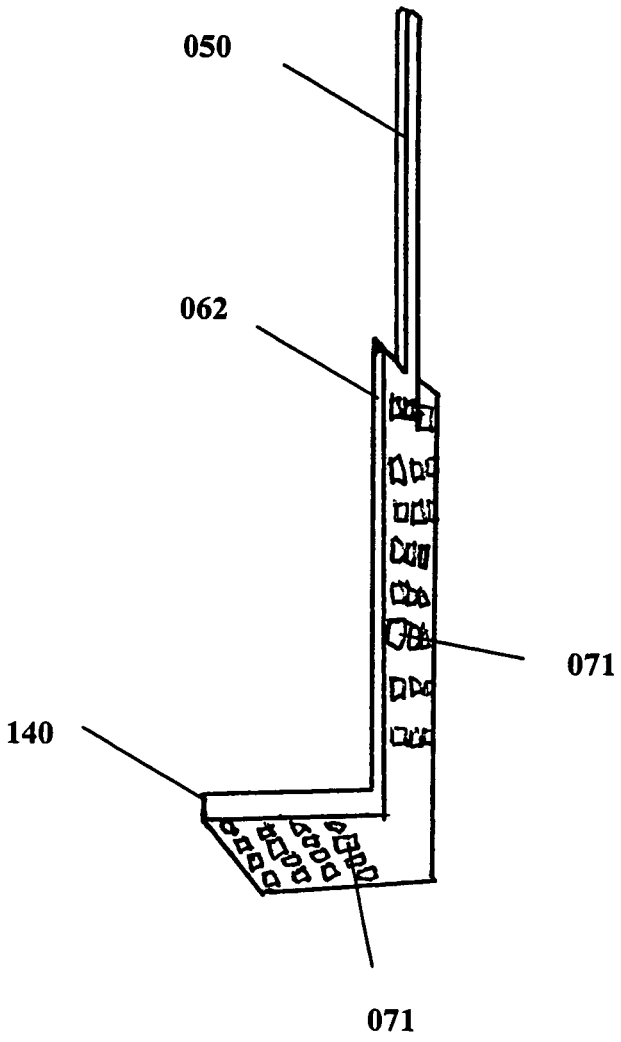

FIG. 6) shows the "grid paint dipper" with a flat reservoir with holes at a 90 degree angle to the grid plate with holes.

Figure 7:
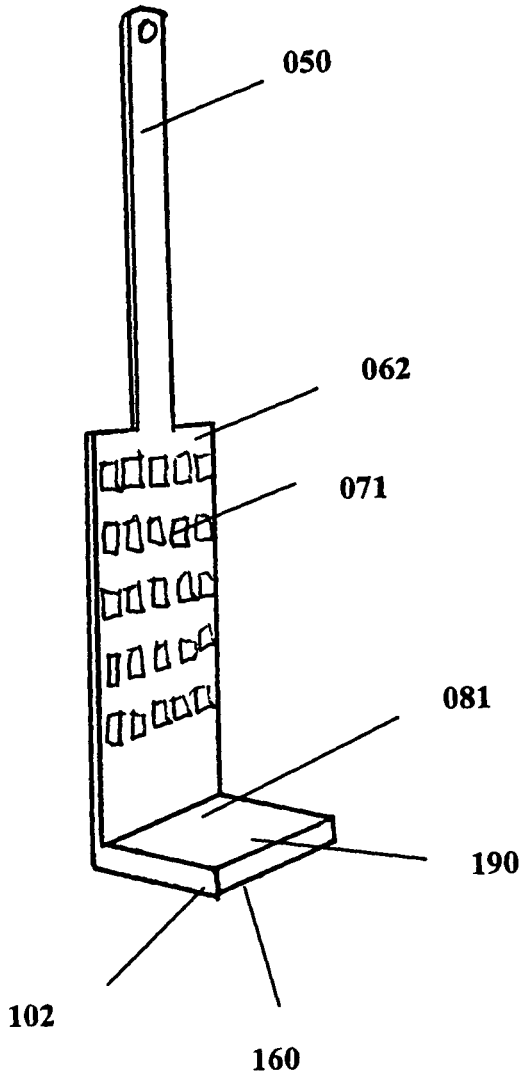

FIG. 7) shows the "grid paint dipper" with a flat square tongue reservoir at a 90 degree angle to the grid plate with holes.

Figure 8:
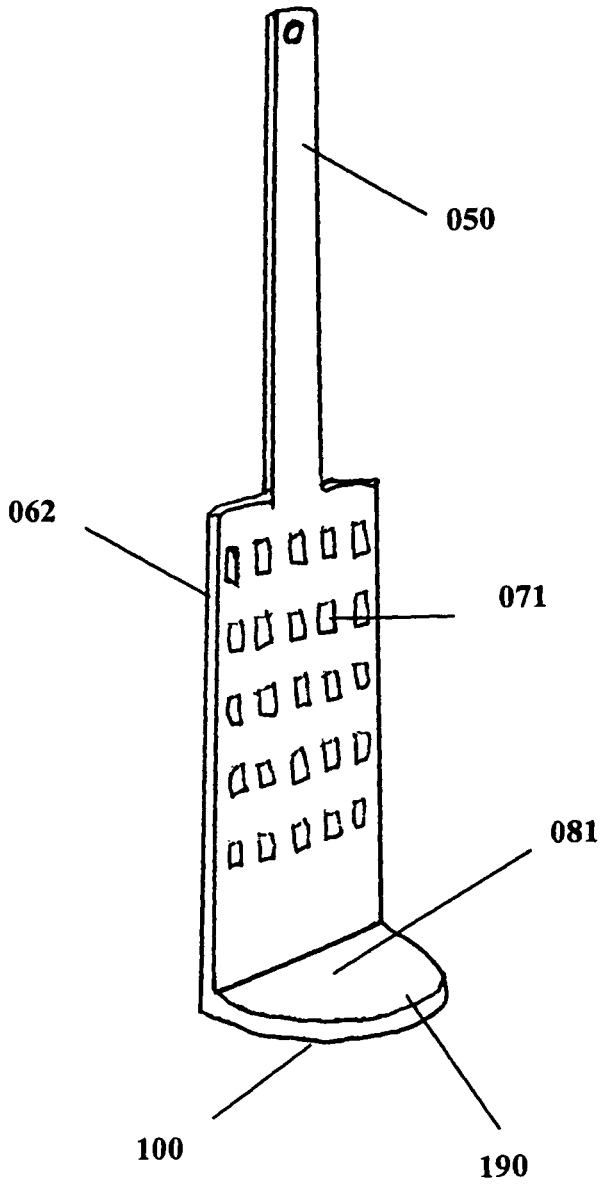

FIG. 8) shows the "grid paint dipper" with a grip plate with holes and a round edge flat tongue reservoir.

Figure 9:
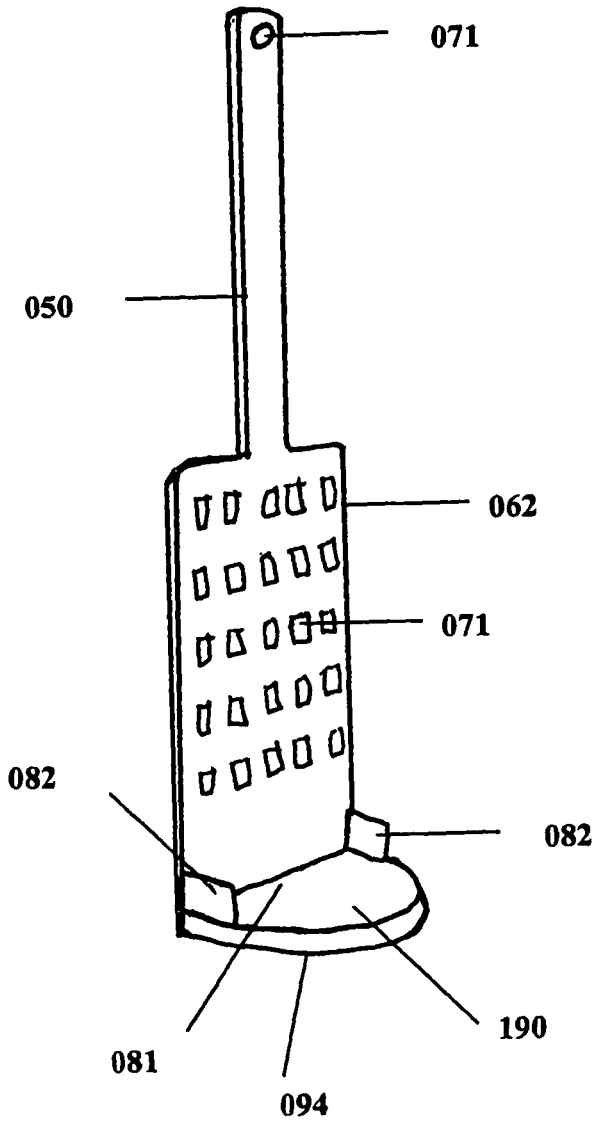

FIG. 9) shows the "grid paint dipper" with a grid plate with holes and a round edge flat tongue reservoir with partial side walls.

Figure 10:
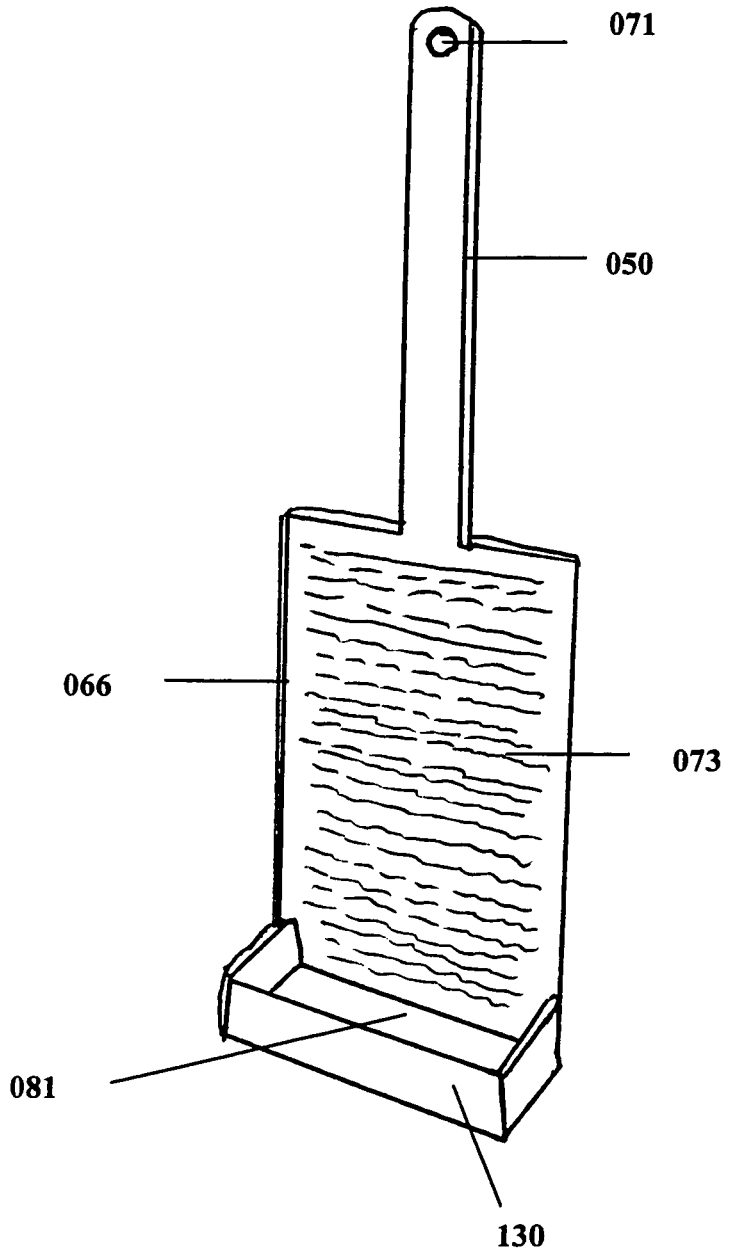

FIG. 10) shows the "grid paint dipper" with a rough surface grid plate and a rectangular tray shaped paint reservoir.

Figure 11:
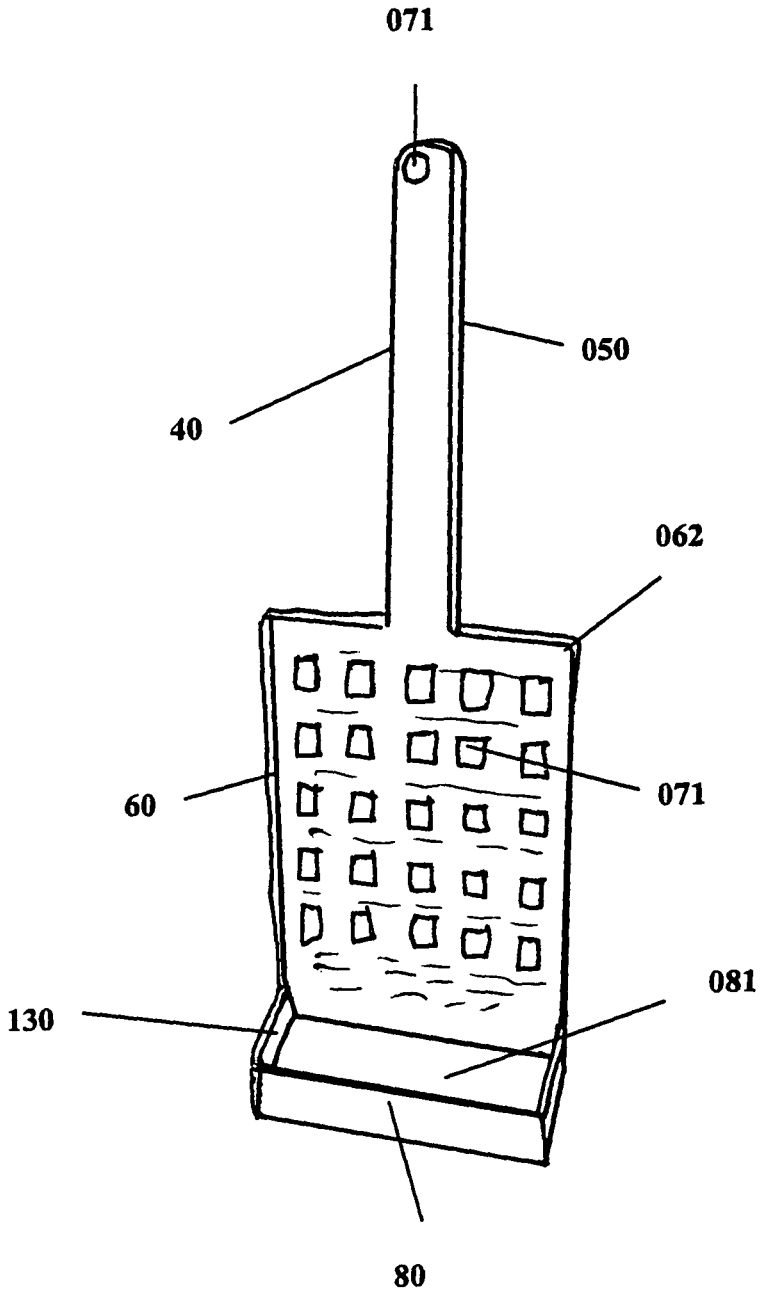

FIG. 11) shows the "grid paint dipper" with a rectangular tray shaped paint reservoir and a gripe plate with holes.

Figure 12:
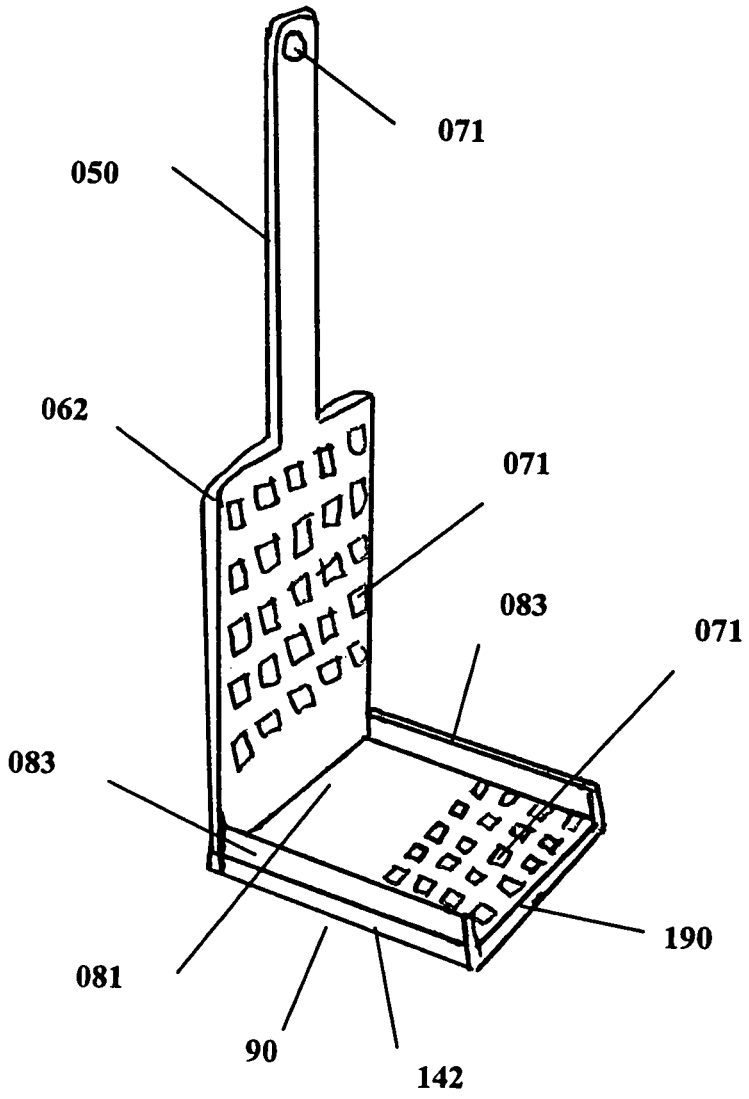

FIG. 12) shows the "grid paint dipper" with a grid plate with holes and a reservoir with a paint removing surface with holes and fully extended side walls and a larger paint holding area.

Figure 13:
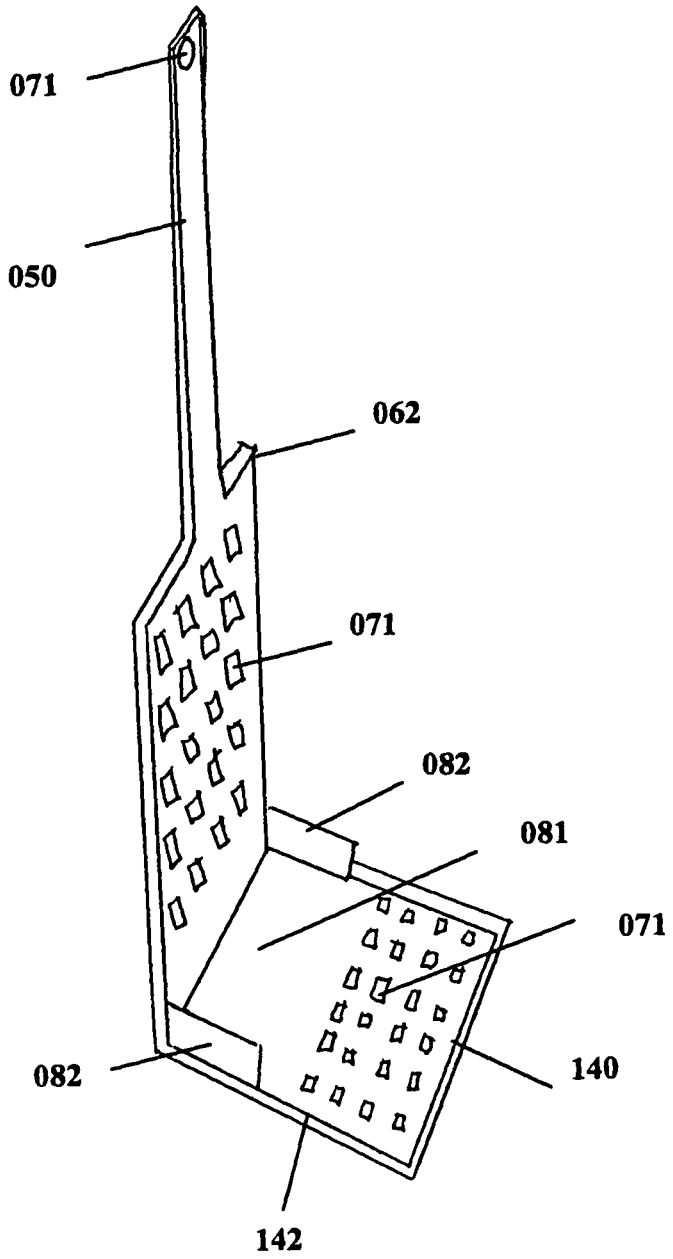

FIG. 13) show the "grid paint dipper" with a grid plate with holes and a reservoir with a paint removing surface with holes and partially extended side walls and a larger paint holding area.

Figure 14:
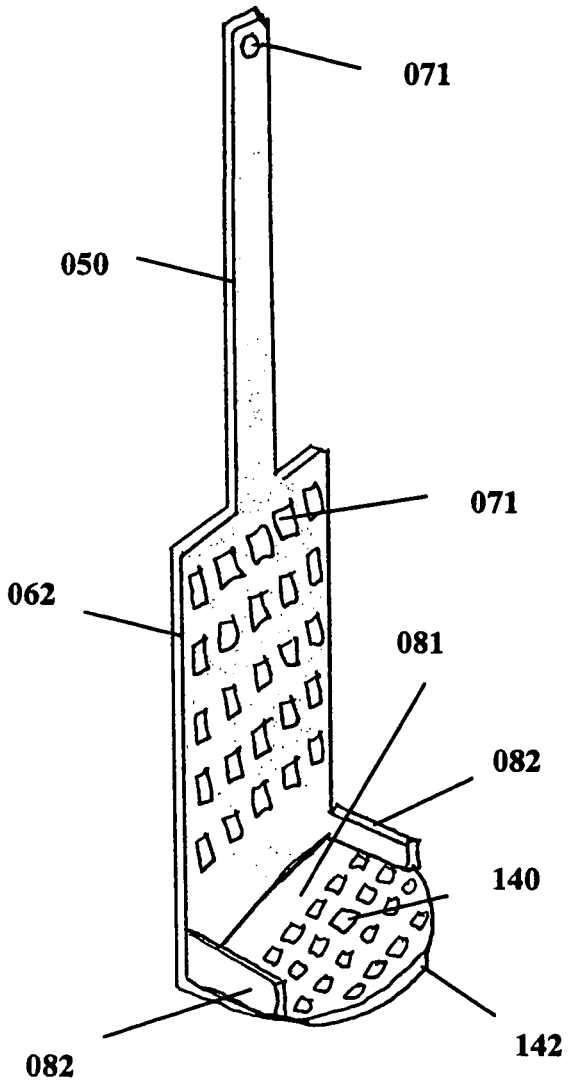

FIG. 14) shows the "grid paint dipper" with a grid plate with holes and a flat rounded edge tongue reservoir with holes and partial side walls.

Figure 15:
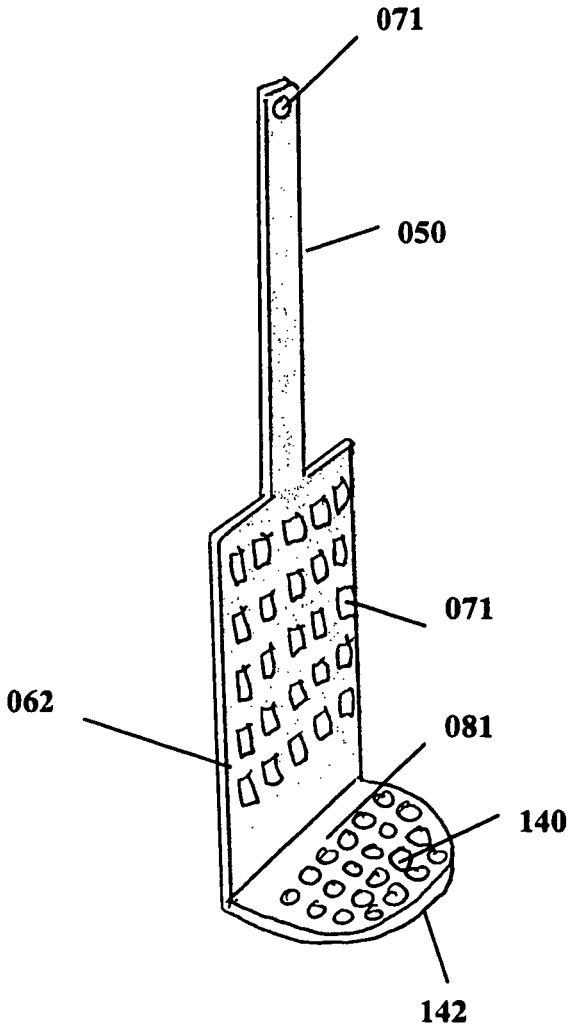

FIG. 15) shows the "grid paint dipper" with a grid plate with holes and a flat rounded edge tongue reservoir with holes.

Figure 16:
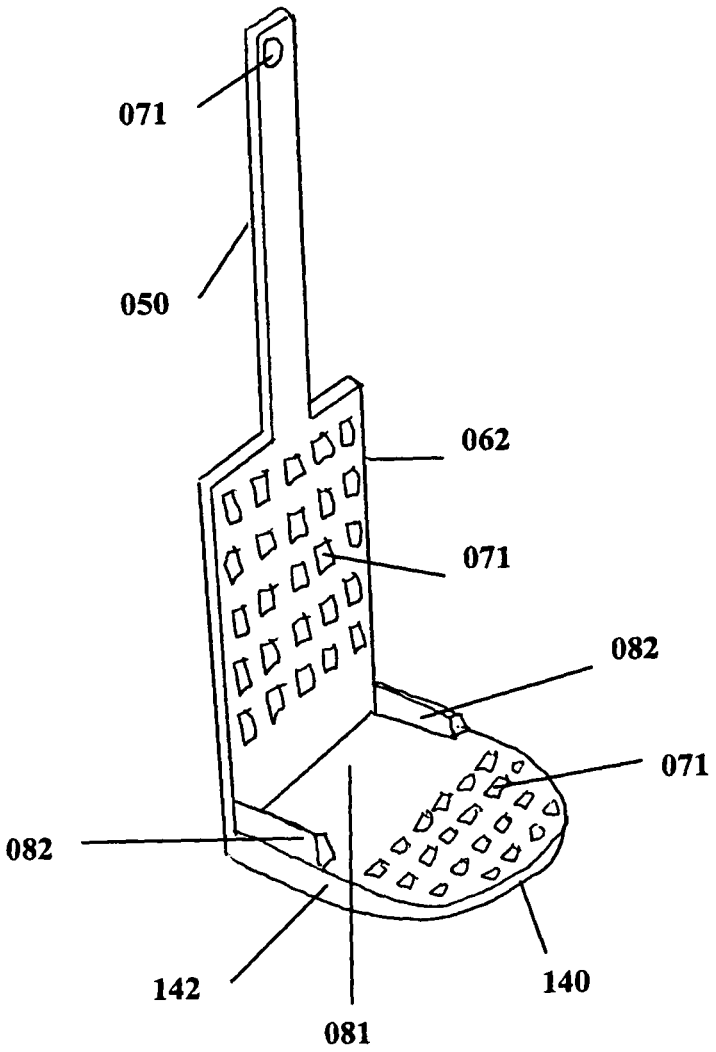

FIG. 16) shows the "grid paint dipper" with a grid plate with holes and a flat rounded edge tongue reservoir with holes and partial side walls and a larger paint holding area.

Figure 17:
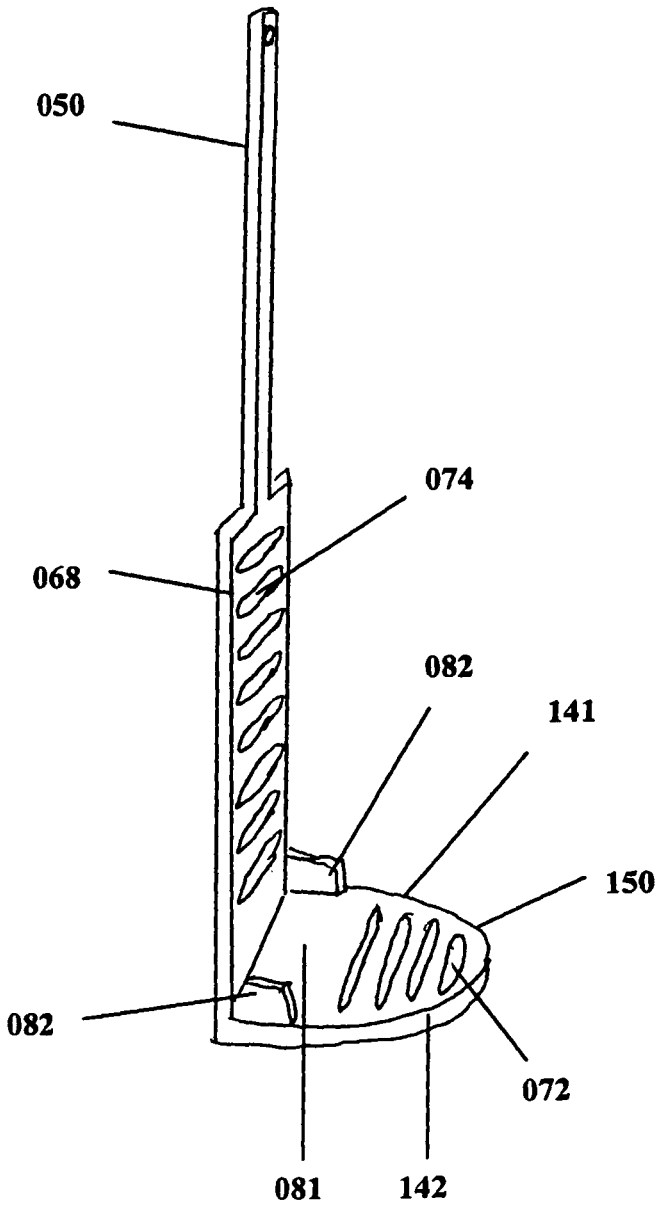

FIG. 17) shows the "grid paint dipper" with a grid plate with grooves and a flat bottom rounded edge reservoir with partial side walls and paint removing slotted surface.

Figure 18:
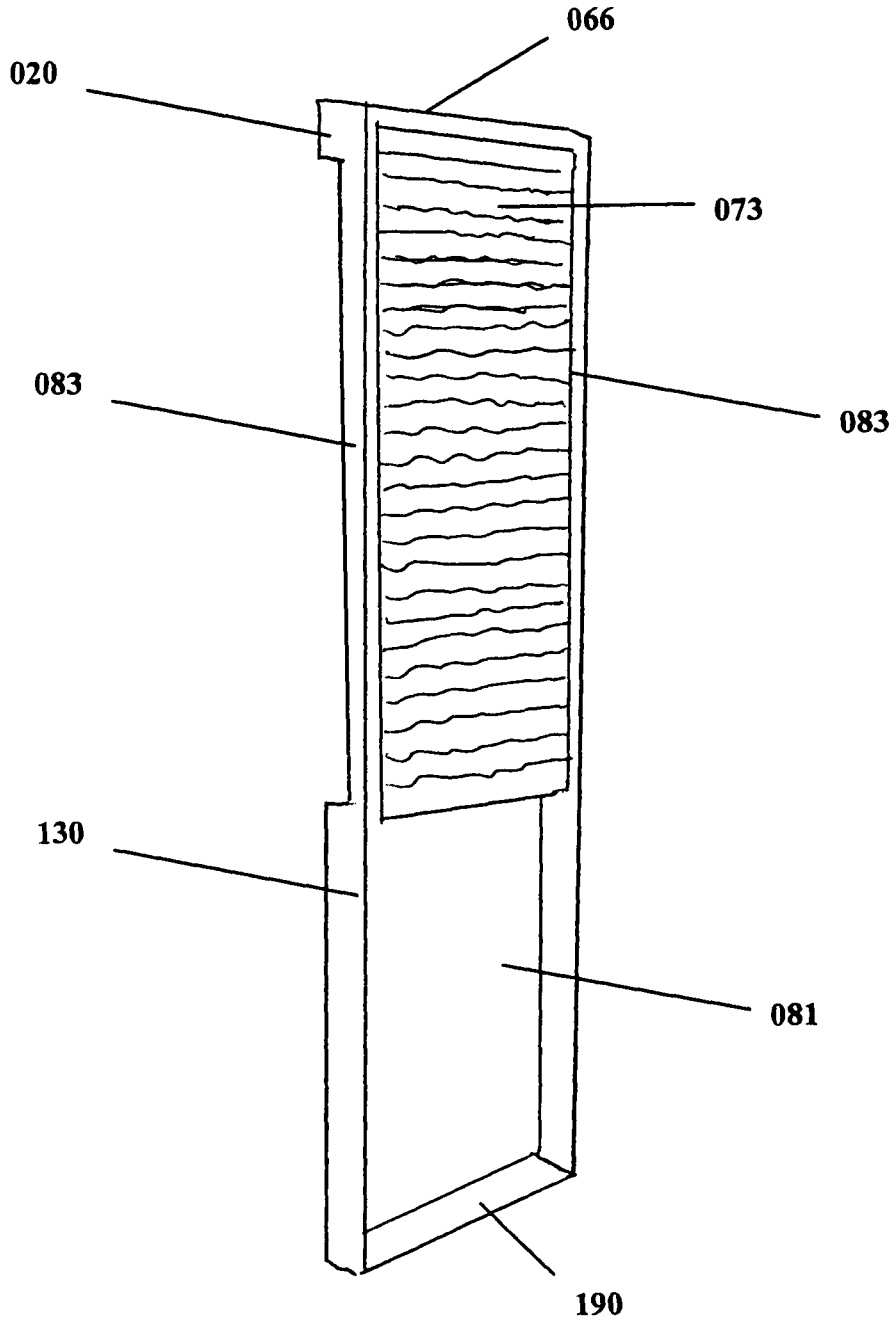

FIG. 18) shows the "grid paint dipper" with a handle edge and a grid plate with raised lines and a rectangular shaped tray for a reservoir.

Figure 19:
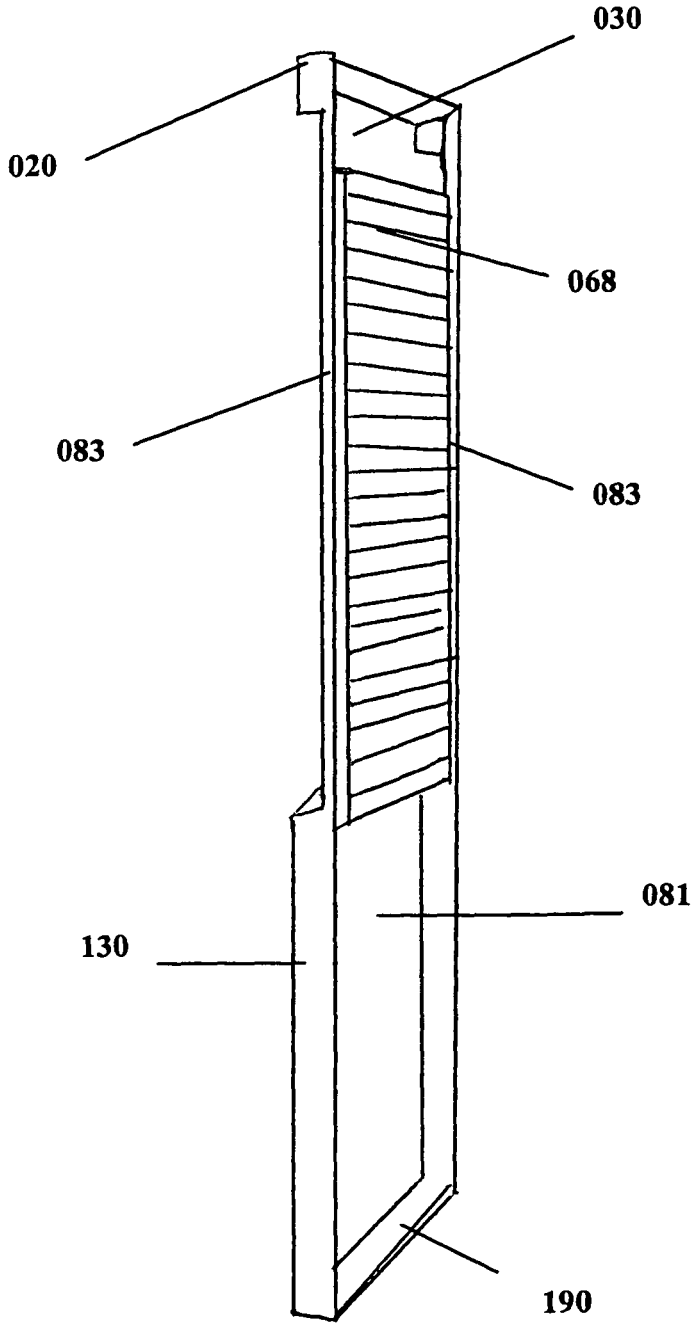

FIG. 19) shows the "grid paint dipper" with a handle edge having an opened finger area and a grid plate with raised lines and a rectangular shaped tray for a reservoir.

Figure 20:
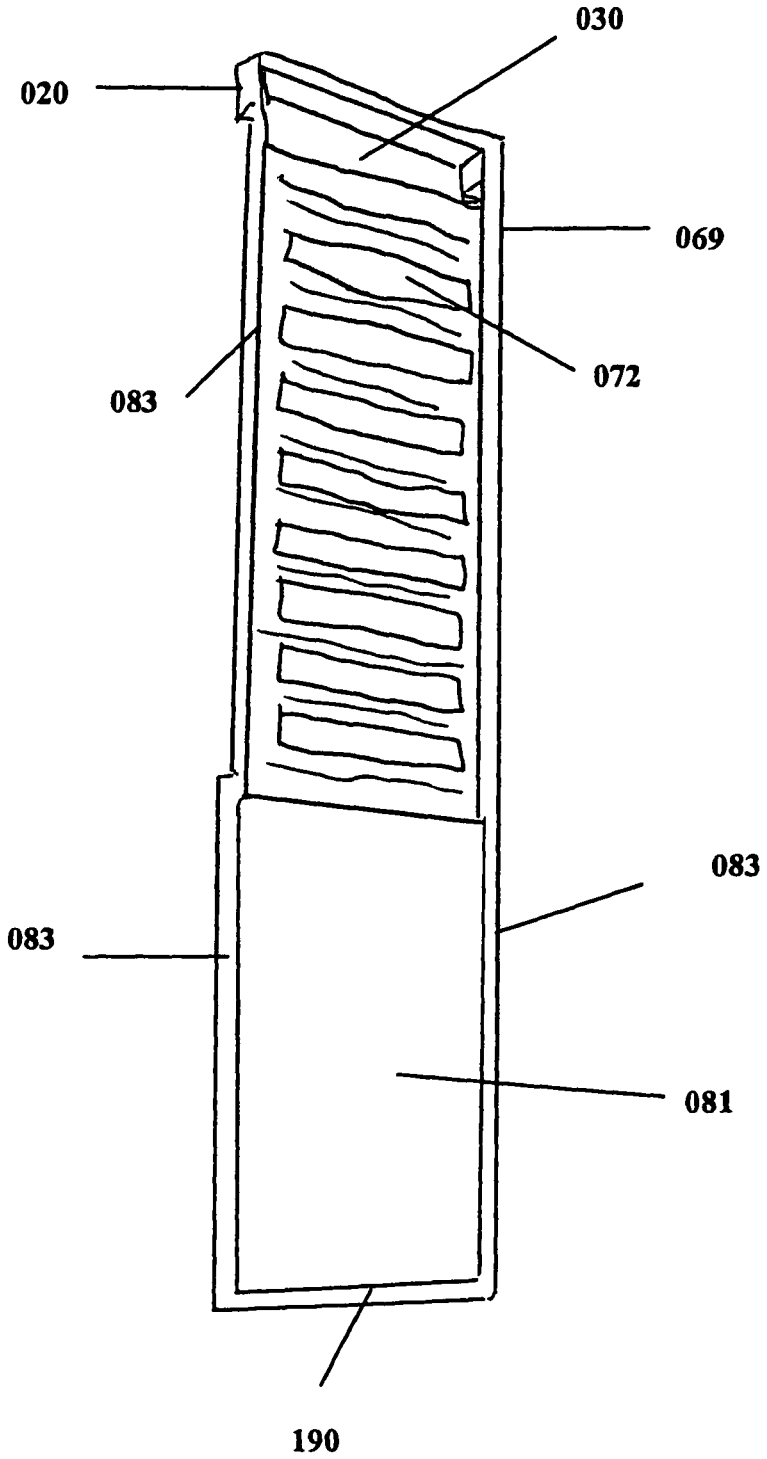

FIG. 20) shows the "grid paint dipper" with a handle edge having an opened finger area and a grid plate with slots and a rectangular shaped tray for a reservoir.

Figure 21:
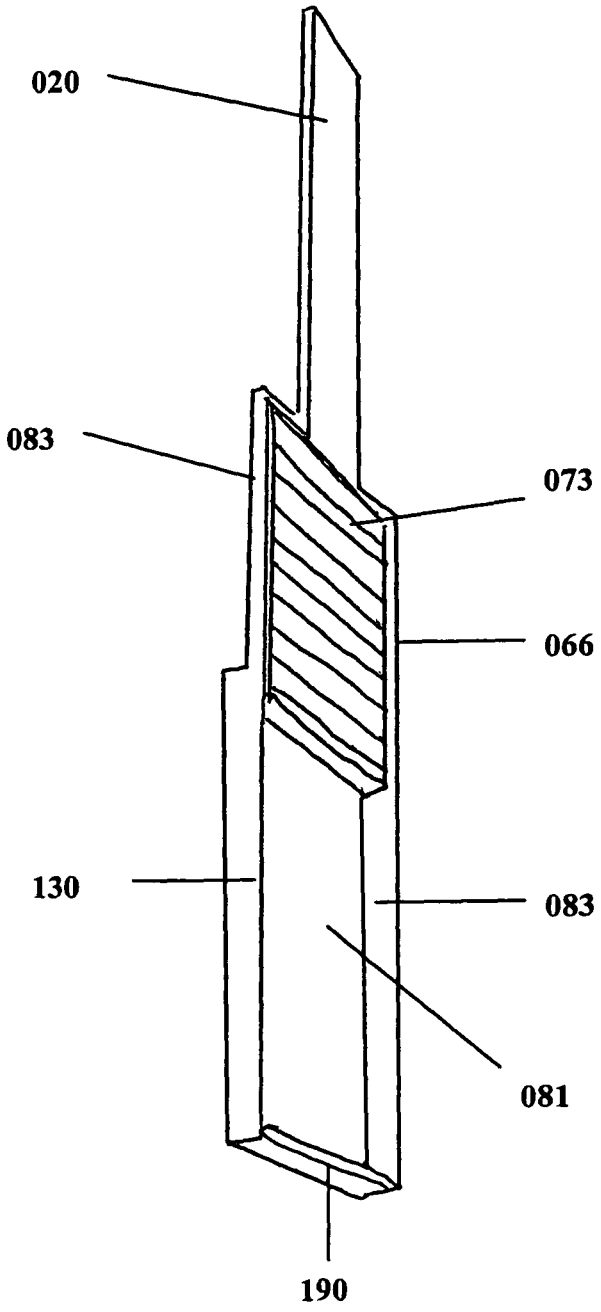

FIG. 21) shows the "grid paint dipper" with a long handle and a grid plate with raised lines and a rectangular shaped tray for a reservoir.

Figure 22:
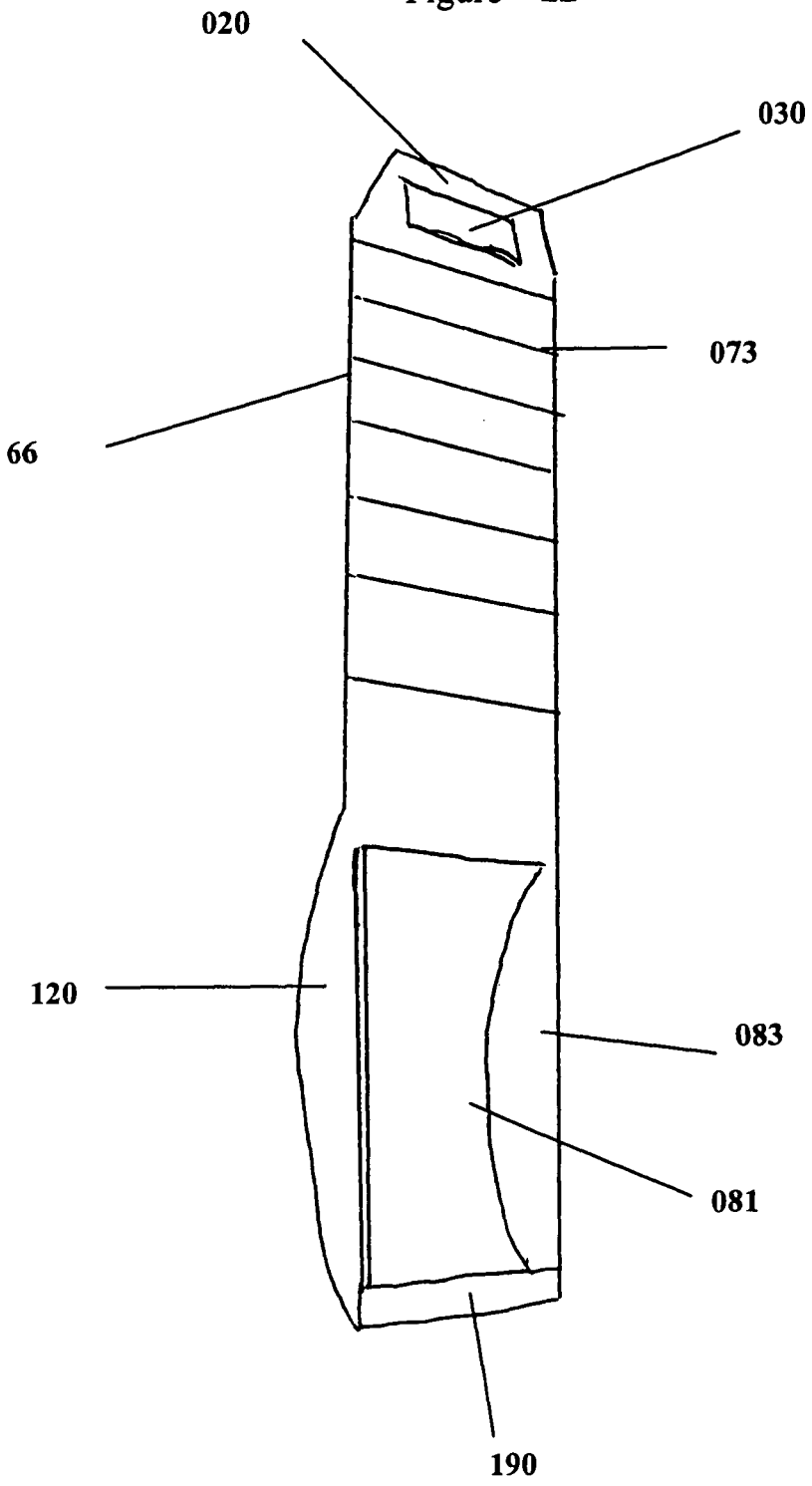

FIG. 22) shows the "grid paint dipper" with a handle edge having an opened finger area and a grid plate with raised lines and a bowl shaped tray for a reservoir.

Figure 23:
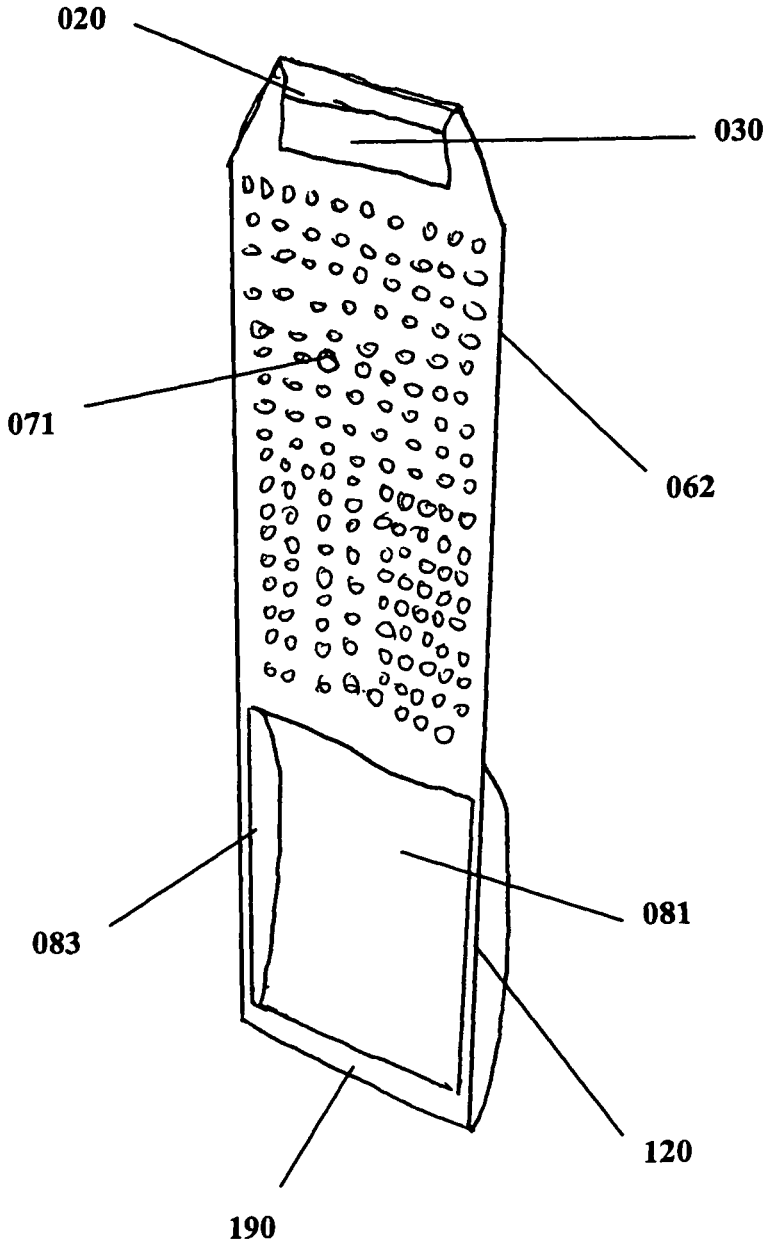

FIG. 23) shows the "grid paint dipper" with a handle edge having an opened finger area and a grid plate with holes and a bowl shaped tray for a reservoir.

Figure 24:
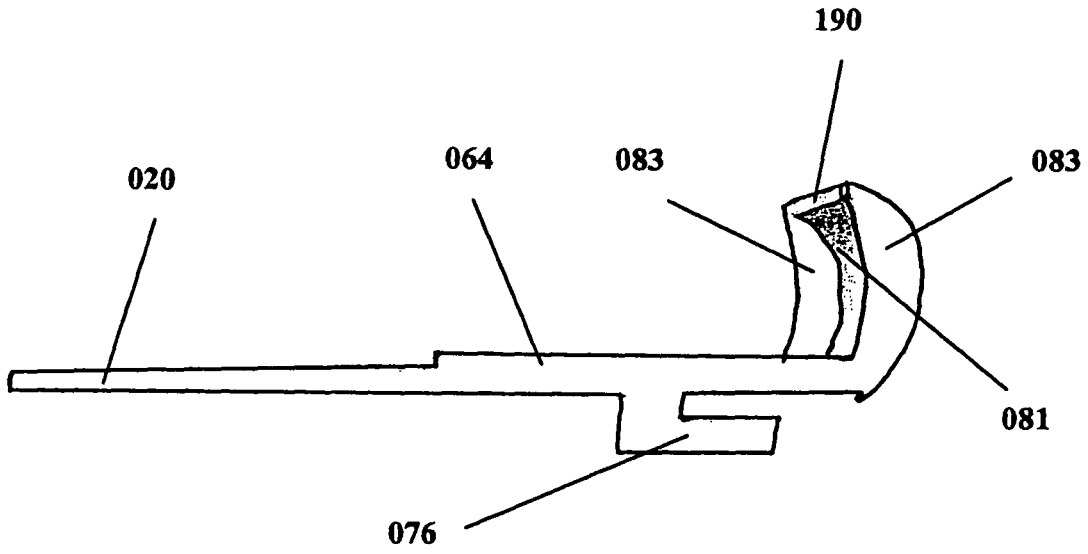

FIG. 24) shows the "grid paint dipper" with a long handle and a grid plate with raised bumps and a barrel shaped tray for a reservoir with a hook on the back or the "grid paint dipper" to allow the "grid paint dipper to rest on the lip of a container.

Figure 25:
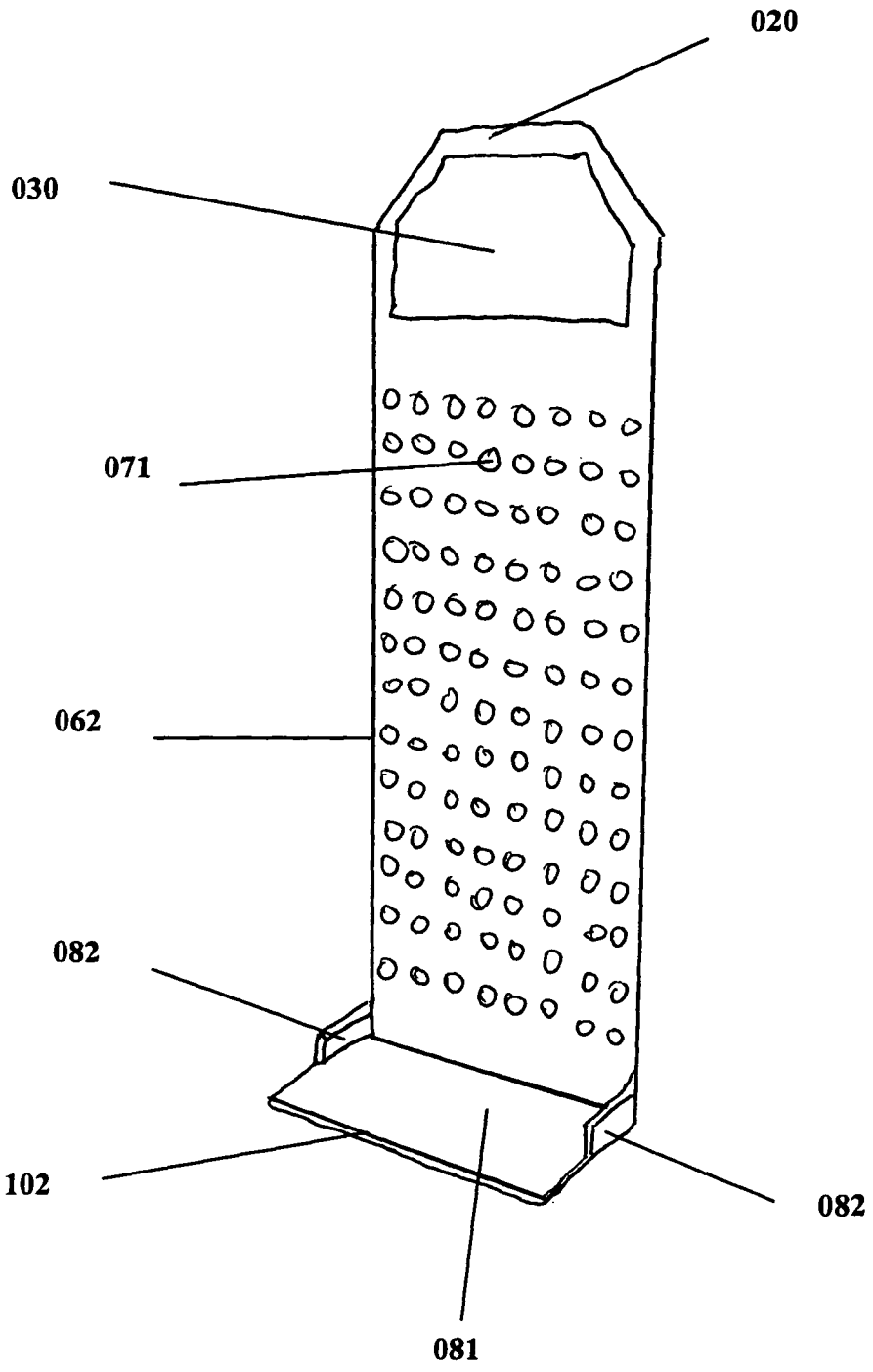

FIG. 25) shows the "grid paint dipper" with a handle edge having an open finger area with a flat square tongue reservoir with partial side walls at a 90 degree angle to the grid plate with holes.

Figure 26:
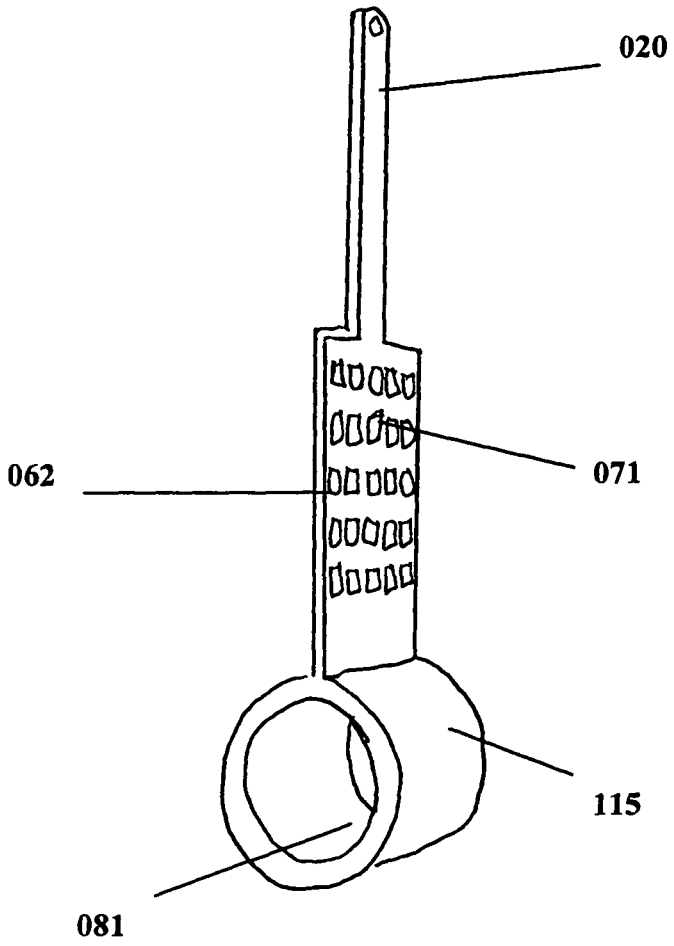

FIG. 26) shows the "grid paint scooper" with a grip plate with holes and a cylindrical shaped scooper.

Figure 27:
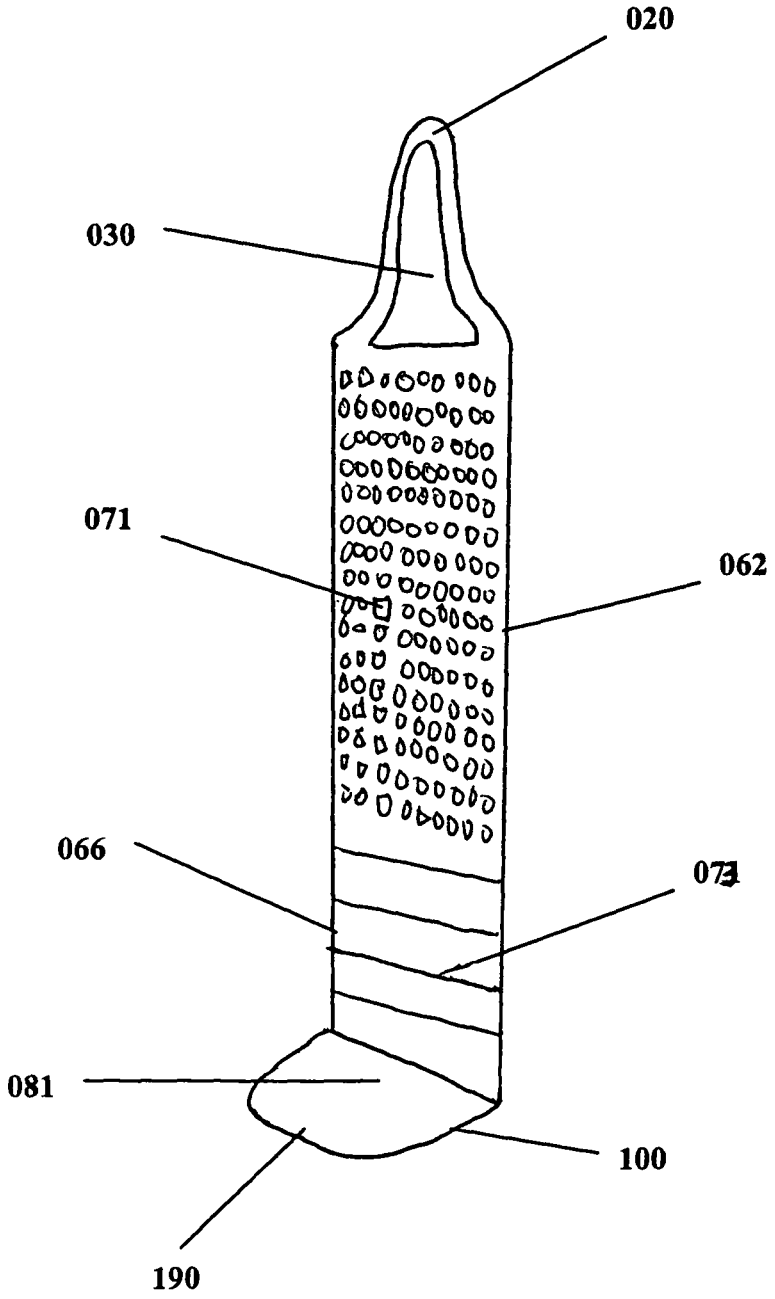

FIG. 27) shows the preferred "grid paint dipper" with a grid plate with holes and raised lines on the surface with curved handle and flat curved shaped reservoir.

Figure 28:
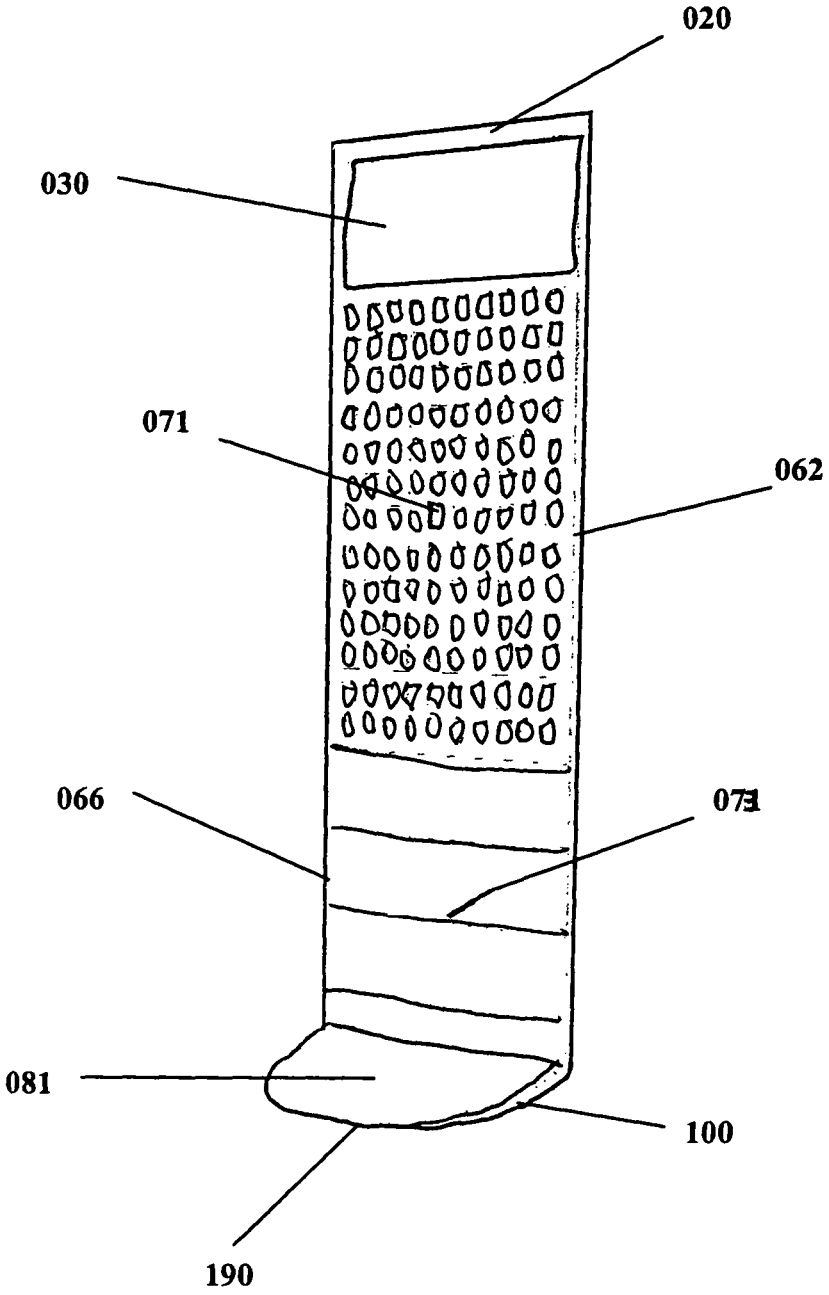

FIG. 28) shows the preferred "grid paint dipper" with a grid plate with holes and raised lines on surface with square handle and flat curved shaped reservoir.

REFERENCE NUMERALS IN DRAWINGS

010 grid paint dipper
020 handle
030 slotted shaped handle
040 solid handle
050 handle with hanging hole
060 paint roller cover wiper grid plate
062 flat wiper grid plate with equal spaced holes
064 flat wiper grid plate with equal spaced raised bumps
066 flat wiper grid plate with equal spaced raised lines
068 flat wiper grid plate with equal spaced grooves
069 flat wiper grid plate with equal spaced slots
070 flat wiper grid plate with textured surface
071 holes
072 slots

073 raised lines
074 grooves
075 rough surface
076 paint container hook to rest grid paint dipper on
080 paint dipper reservoir
081 paint holding area
082 paint partial side walls
083 full side walls
090 full side wall paint reservoir
094 partial side wall & extended tongue reservoir
100 flat bottom tongue paint reservoir
102 flat square tongue paint reservoir
110 barrel shaped paint reservoir
115 cylinder shaped paint reservoir
120 bowl shaped paint reservoir
130 rectangular tray shaped paint reservoir
140 a dipper with holes in the reservoir surface
141 a dipper with slots in the reservoir surface
142 a dipper with a paint removing surface
150 a dipper with grooves in the reservoir surface
160 a dipper with raised protrusion in the reservoir surface
180 dual reservoirs on the front & back of the grid plate
190 dipper tongue

DESCRIPTION

Preferred Grid Paint Dipper

The "grid paint dipper 010" main parts generally comprises of a paint roller cover wiper grid plate 060, a handle 020 attached to the top of said paint roller'cover grid plate 060, and a paint dipper reservoir 080, attached to the bottom of said paint roller cover wiper grid plate 060.

The paint roller cover wiper grid plate 060 can be made in a plurality of shapes comprising a flat wiper grid plate with equal spaced holes 062, a flat wiper grid plate with equal spaced raised bumps 064, a flat wiper grid plate with equal spaced raised lines 066, a flat wiper grid plate with equal spaced grooves 068, or a flat wiper grid plate with textured surface 070.

The handle 020, can be made in a plurality of shapes comprising a slotted shaped handle 030, a solid handle 040, or a handle with hanging hole 050. The handle 020 is most suitably attached to the top of the paint roller cover wiper grid plate 060.

The paint dipper reservoir 080 can be made in a plurality of shapes comprising a full side wall paint reservoir 090, a partial side wall & extended tongue reservoir 094, a flat bottom tongue paint reservoir 100, a barrel shaped paint reservoir 110, a bowl shaped paint reservoir 120, a rectangular tray shaped paint reservoir 130, a dipper with holes in the reservoir surface 140, a dipper with grooves in the reservoir surface 150, a dipper with raised protrusion in the reservoir surface 160 or dual reservoirs on front & back of grid plate 180.

The paint dipper reservoir 080 is most suitably attached to the bottom of the paint roller cover wiper grid plate 060 so that it can be the first section dipped into the paint can or pail during use.

The grid paint dipper 010, can be manufactured in a plurality of ways comprising molded, machined, laser cut, water cut, plasma cut, wire EDM cut, die cut and stamped. The preferred method is injection molding due to the low cost for high volume. There are a plurality of materials the slotted patterned frame 020, can be made from comprising plastic, metal, and wood. The preferred material is plastic in high volume applications.

Advantages

From the description above, a number of advantages of the "grid paint dipper" become evident:

a) provides an easier way to apply paint to paint roller covers in addition to a way to remove excess paint from the roller covers while distributing paint evenly across roller covers;

b) provides a faster way to apply paint to paint roller covers in addition to a way to remove excess paint from the roller covers while distributing paint evenly across roller covers;

c) provides a more efficient way to apply paint to paint roller covers in addition to a way to remove excess paint from the roller covers while distributing paint evenly across roller covers;

d) provides a way to scoop paint from the bottom of a paint can or pail when paint is at a very low level to apply paint to paint roller covers in addition to a way to remove excess paint from the roller covers while distributing paint evenly across roller covers;

e) provides a simple way to apply paint to paint roller covers in addition to a way to remove excess paint from the roller covers while distributing paint evenly across roller covers;

f) provides a way better way to apply paint to dual angled paint roller covers in addition to a way to remove excess paint from the roller covers while distributing paint evenly across roller covers;

Further objectives and advantages of my invention will become apparent from a consideration of the drawings and ensuing description.

Operation (Grid Paint Dipper)

After opening up a can of paint the painter would insert the "grid paint dipper" into the can of paint. While holding the "grid paint dipper" by the handle the painter could either dip a paint roller that has a single cover into the can of paint to soak the cover with paint and then roll the cover onto the grid plate to remove excess paint from the roller cover. As the paint in the can gets too low the "grid paint dipper" could scrape paint from the bottom of the paint can and be raised out of the can while an adequate amount of paint would still be held in the dipper and this remaining paint can either be poured from the dipper onto the paint roller cover or the cover could be placed into the dipper to soak up the paint that has been scooped out of the bottom of the paint can.

When you have a paint roller that has dual covers at angles then there is a problem with dipping the rollers into the paint can because the entire cover, shaft and part of the handle would be over soaked with paint. The advantage of my invention is that with the addition of the dipper there is no need to dip the roller covers into the paint. You can stiller scoop up paint using the dipper attached to the bottom of my grid plate and then either pour paint from the dipper onto the roller cover or dip each angled roller cover into the dipper to soak the cover knit material with paints instead of having to fully soak the entire roller cover in the can of paint. The grid can be held between the angled roller covers and one cover could be roller on the front side of the grid plate and then the other roller cover could be rolled on the back side of the grid plate to remove excess paint from each roller cover. The dipper is made to only hold an adequate and sufficient amount of paint so that the roller cover will not have to be immersed into the can of paint and the operator can put a more controllable amount of paint onto the roller cover.

Conclusions, Ramifications, and Scope

Accordingly, the reader will see that the "grid paint dipper" of this invention has advantages in that a) it provides an easier way to apply paint to paint roller covers in addition to a way to remove excess paint from the roller covers while distributing paint evenly across roller covers;

b) it provides a faster way to apply paint to paint roller covers in addition to a way to remove excess paint from the roller covers while distributing paint evenly across roller covers;

c) it provides a more efficient way to apply paint to paint roller covers in addition to a way to remove excess paint from the roller covers while distributing paint evenly across roller covers;

d) it provides a way to scoop paint from the bottom of a paint can or pail when paint is at a very low level to apply paint to paint roller covers in addition to a way to remove excess paint from the roller covers while distributing paint evenly across roller covers;

e) it provides a simple way to apply paint to paint roller covers in addition to a way to remove excess paint from the roller covers while distributing paint evenly across roller covers;

f) it provides a way better way to apply paint to dual angled paint roller covers in addition to a way to remove excess paint from the roller covers while distributing paint evenly across roller covers;

Further objectives and advantages of my invention will become apparent from a consideration of the drawings and ensuing description.

Although the description above contains much specificity, these should not be construed as limiting the scope of the invention but as merely providing illustrations of some of the presently preferred embodiments of the invention.

Thus the scope of the invention should be determined by the appended claims and their legal equivalents, rather than just by the examples given.

I claim:

1. A grid paint scooping device for scooping paint from a container and removing excess paint from a paint roller, comprising:

a substantially planar wiping plate having a front side, a back side, a top and a bottom where a paint removing feature is disposed on said front side and/or back side and said paint removing feature is selected from the group comprising grooves, raised protrusions, bumps, raised lines, holes and slots;

a handle attached to the top of said wiping plate;

a substantially planar paint scooping plate having a front side, back side, top side and bottom side where the back side of said paint scooping plate is attached to the bottom of said wiping plate such that said wiping plate is disposed substantially perpendicular to said paint scooping plate having a reservoir portion in contact with said wiping plate and a tongue extending from said reservoir portion to the front side of said paint scooping plate;

said reservoir portion having two side walls extending upwardly from the top side of said paint scooping plate and attached to said wiping plate defining a reservoir for holding paint, said tongue having said paint removing feature disposed on the top side thereof.

2. The grid paint scooping device of claim 1, wherein said two vertical side walls extend along the entire length of said reservoir portion and tongue of said paint scooping plate.

3. The grid scooping device of claim 1, wherein said reservoir portion and said tongue of said paint scooping plate form a rectangular shape, square shape, oval shape or a semi-circular shape.

4. The grid scooping device of claim 1, wherein said reservoir portion of said paint scooping plate is rectangular and said tongue of said paint scooping plate is semi-circular.

5. The grid scooping device of claim 1, wherein a hole is provided in a free end of said handle for hanging the grid scooping device.

6. The grid scooping device of claim 1, wherein said paint scooping plate is permanently or removably attached to said wiping plate.

7. The grid scooping device of claim 1, wherein a paint container attachment comprising a hook, clip or bracket is attached to said wiping plate for attaching the grid scooping device to a paint container.

* * * * *